US007645016B2

(12) United States Patent
Sato et al.

(10) Patent No.: US 7,645,016 B2
(45) Date of Patent: Jan. 12, 2010

(54) LIQUID EJECTION METHOD AND LIQUID EJECTION APPARATUS

(75) Inventors: Akito Sato, Matsumoto (JP); Naoki Sudo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 229 days.

(21) Appl. No.: 11/951,200

(22) Filed: Dec. 5, 2007

(65) Prior Publication Data

US 2008/0150978 A1 Jun. 26, 2008

(30) Foreign Application Priority Data

Dec. 21, 2006 (JP) ..... 2006-344841

(51) Int. Cl.
*B41J 29/393* (2006.01)

(52) U.S. Cl. ..... 347/19; 347/41

(58) Field of Classification Search ..... 347/19, 347/12, 15, 41; 358/504
See application file for complete search history.

(56) References Cited

U.S. PATENT DOCUMENTS

| | | | | |
|---|---|---|---|---|
| 6,832,825 | B1 | 12/2004 | Nishikori et al. | |
| 7,198,347 | B2 * | 4/2007 | Tayuki | 347/19 |
| 7,216,948 | B2 * | 5/2007 | Matsuzaki et al. | 347/14 |
| 7,296,872 | B2 * | 11/2007 | Hayashi et al. | 347/19 |
| 7,377,613 | B2 * | 5/2008 | Yamazaki et al. | 347/19 |

FOREIGN PATENT DOCUMENTS

| | | | |
|---|---|---|---|
| JP | 07047713 | A | 2/1995 |
| JP | 2000-318145 | | 11/2000 |
| JP | 2001105697 | A | 4/2001 |
| JP | 2005178000 | A | 7/2005 |

* cited by examiner

*Primary Examiner*—Lamson D Nguyen
(74) *Attorney, Agent, or Firm*—Hogan & Hartson LLP

(57) ABSTRACT

A liquid ejection method includes: (A) moving nozzles relative to a medium, (B) ejecting liquid from the nozzles while the nozzles are moving relative to the medium, (C) forming a first pattern on the medium with the liquid ejected from the nozzles at either one of a timing delayed from a certain reference timing by a predetermined interval and a timing preceding the certain reference timing by a predetermined interval while the nozzles are moving in a certain direction with respect to the medium, and (D) when the first pattern has been formed on the medium with the liquid ejected from the nozzles at the timing delayed by the predetermined interval, forming a second pattern on the medium with the liquid ejected from the nozzles at a timing delayed from the certain reference timing by an interval equal to the predetermined interval while the nozzles are moving in a direction opposite to the certain direction with respect to the medium, and when the first pattern has been formed on the medium with the liquid ejected from the nozzles at the timing preceding by the predetermined interval, forming the second pattern on the medium with the liquid ejected from the nozzles at a timing preceding the certain reference timing by an interval equal to the predetermined interval while the nozzles are moving in the direction opposite to the certain direction with respect to the medium.

8 Claims, 20 Drawing Sheets

(1) NO PIXEL SHIFTING (2) SHIFTING CORRESPONDING TO ONE PIXEL TO LEFT (3) SHIFTING CORRESPONDING TO ONE PIXEL TO RIGHT

《FIRST STEP》

《SECOND STEP》

《THIRD STEP》

《FOURTH STEP》

(1) NOZZLES #1 TO #90

《FORWARD PASS/RETURN PASS》

(1) NOZZLES #1 TO #60

《FORWARD PASS/RETURN PASS》

(2) NOZZLES #61 TO #90

《FORWARD PASS》

《RETURN PASS》

(1) NOZZLES #1 TO #30

《FORWARD PASS》

《RETURN PASS》

(2) NOZZLES #31 TO #60

《FORWARD PASS》

《RETURN PASS》

(3) NOZZLES #61 TO #90

《FORWARD PASS》

《RETURN PASS》

LIQUID EJECTION METHOD AND LIQUID EJECTION APPARATUS

CROSS-REFERENCE TO RELATED APPLICATIONS

The present application claims priority upon Japanese Patent Application No. 2006-344841 filed on Dec. 21, 2006, which is herein incorporated by reference.

BACKGROUND

1. Technical Field

The present invention relates to liquid ejection methods and liquid ejection apparatuses.

2. Related Art

An inkjet printer is known as a liquid ejection apparatus that ejects ink in the form of liquid onto a medium to perform printing. With regard to ink, this inkjet printer ejects various colors of ink, cyan (C), magenta (X), yellow (Y) or black (K) for example, from nozzles onto a medium to perform printing. Nozzles that eject such inks are provided in a moving member called a "carriage" that moves relative to a medium. When printing is performed, the carriage moves relative to a medium and ink is ejected from nozzles onto the medium. In this manner, printing is performed onto the entire medium.

Incidentally, such an inkjet printer has a problem that when ink is ejected onto a medium from nozzles that are moving relative to the medium, the landing position of ink ejected from the nozzles is displaced along the nozzle movement direction. In such a case, there may be an adverse effect on the printed image quality. In particular, when printing is performed by ejecting ink while moving nozzles back and forth relative to a medium, the landing positions of ink in the forward pass and the return pass are displaced from each other, which may give a significant impact on the printed image quality.

Under such circumstances, conventionally, a technique of changing the timing of ink ejection from nozzles has been employed in order to adjust the landing position of ink (see JP-A-2000-318145). Through this method, the landing position of ink can be adjusted by changing the timing of ink ejection from nozzles. As a result, it is possible to prevent deterioration in the printed image quality.

However, it has been difficult in some cases to sufficiently prevent deterioration in the printed image quality in the upstream-side end portion or the downstream-side end portion of the transported medium. This is because end portions of a medium cease to be secured by a transport section such as a transport roller or the like that transports the medium in order to perform printing on the end portions of the medium. When the end portions of the medium cease to be secured by the transport section such as a transport roller, the end portion of the medium becomes warped and is transported to a printing section in that condition. Consequently, there are cases in which a gap between a printing surface of the medium and nozzles vary, which results in displacement of the ink landing position. This sometimes results in deterioration in the image quality in the upstream-side end portion or the downstream-side end portion with respect to the transport direction of the medium. In particular, recently, efforts have been made to achieve a drastic increase in the carriage movement speed in order to increase the processing speed. Therefore, deterioration in the image quality due to variation in the gap between the printing surface of the medium and the nozzles has become an issue that cannot be neglected.

SUMMARY

The invention has been achieved to address the above-described circumstances, and has an advantage of suppressing deterioration in the image quality in the upstream-side end portion and the downstream-side end portion of a medium transported.

A primary aspect of the invention for achieving the above-described advantage is:

A liquid ejection method including:

(A) moving nozzles relative to a medium;

(B) ejecting liquid from the nozzles while the nozzles are moving relative to the medium;

(C) forming a first pattern on the medium with the liquid ejected from the nozzles at either one of a timing delayed from a certain reference timing by a predetermined interval and a timing preceding the certain reference timing by the predetermined interval while the nozzles are moving in a certain direction with respect to the medium; and (D) when the first pattern has been formed on the medium with the liquid ejected from the nozzles at the timing delayed by the predetermined interval, forming a second pattern on the medium with the liquid ejected from the nozzles at a timing delayed from the certain reference timing by an interval equal to the predetermined interval while the nozzles are moving in a direction opposite to the certain direction with respect to the medium, and when the first pattern has been formed on the medium with the liquid ejected from the nozzles at the timing preceding by the predetermined interval, forming the second pattern on the medium with the liquid ejected from the nozzles at a timing preceding the certain reference timing by an interval equal to the predetermined interval while the nozzles are moving in the direction opposite to the certain direction with respect to the medium.

Features of the invention other than the above will become clear by reading the description of the present specification with reference to the accompanying drawings.

DESCRIPTION OF EXEMPLARY EMBODIMENTS

Figure 1:
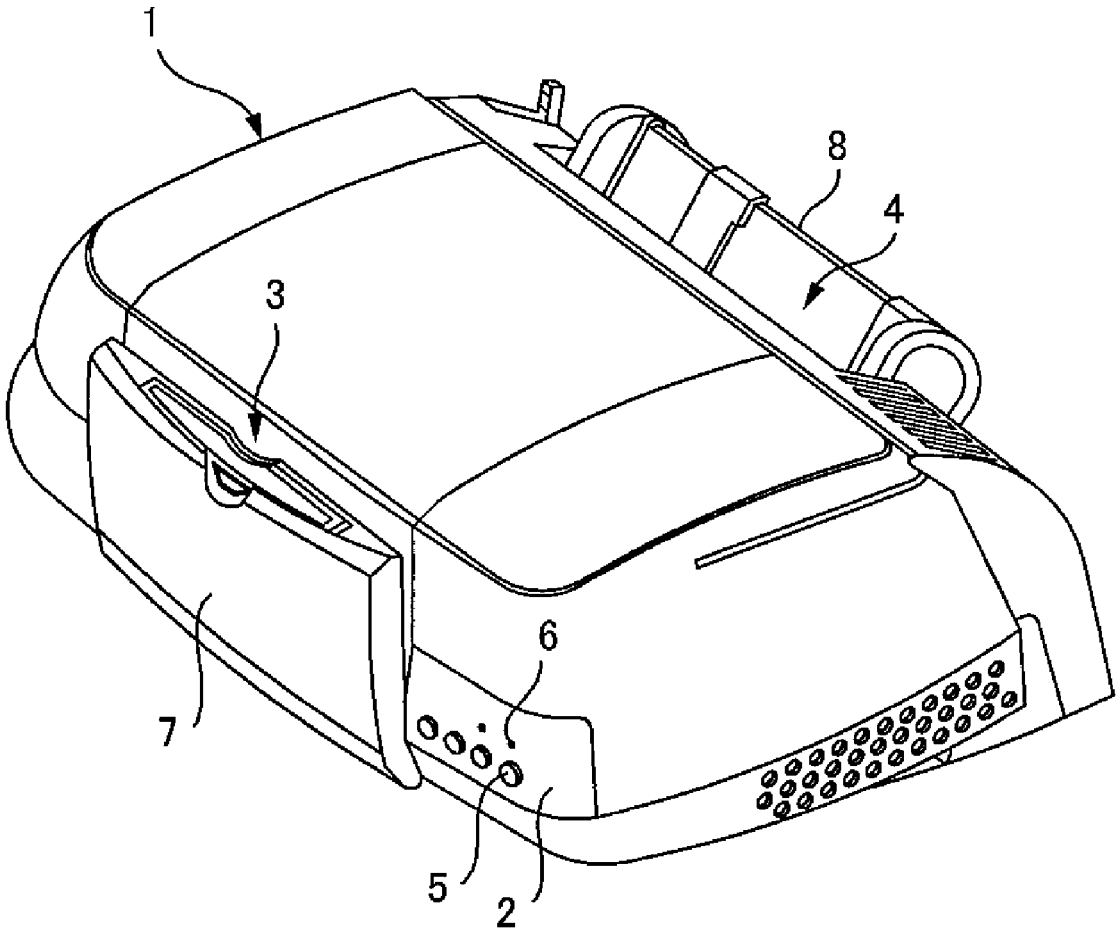
FIG. 1 is a perspective view of an embodiment of a liquid ejection apparatus (printing apparatus).

At least the following matters will be made clear by reading the description of the present specification with reference to the accompanying drawings.

A liquid ejection method including:

(A) moving nozzles relative to a medium;

(B) ejecting liquid from the nozzles while the nozzles are moving relative to the medium;

(C) forming a first pattern on the medium with the liquid ejected from the nozzles at either one of a timing delayed from a certain reference timing by a predetermined interval and a timing preceding the certain reference timing by the predetermined interval while the nozzles are moving in a certain direction with respect to the medium; and (D) when the first pattern has been formed on the medium with the liquid ejected from the nozzles at the timing delayed by the predetermined interval, forming a second pattern on the medium with the liquid ejected from the nozzles at a timing delayed from the certain reference timing by an interval equal to the predetermined interval while the nozzles are moving in a direction opposite to the certain direction with respect to the medium, and when the first pattern has been formed on the medium with the liquid ejected from the nozzles at the timing preceding by the predetermined interval, forming a second pattern on the medium with the liquid ejected from the nozzles at a timing preceding the certain reference timing by an interval equal to the predetermined interval while the nozzles are moving in the direction opposite to the certain direction with respect to the medium.

In such a liquid ejection method, when the first pattern has been formed with the liquid ejected from the nozzles at the timing delayed from the certain reference timing by the predetermined interval while the nozzles are moving in the certain direction with respect to the medium, the second pattern is formed with the liquid ejected from the nozzles at the timing delayed from the certain reference timing by the interval equal to the predetermined interval while the nozzles are moving in the direction opposite to the certain direction with respect to the medium, and when the first pattern has been formed with the liquid ejected from the nozzles at the timing preceding the certain reference timing by the predetermined interval while the nozzles are moving in the certain direction with respect to the medium, the second pattern is formed with the liquid ejected from the nozzles at the timing preceding the certain reference timing by the interval equal to the predetermined interval while the nozzles are moving in the direction opposite to the certain direction with respect to the medium. Therefore, it is possible to suppress deterioration in the image quality in the upstream-side end portion or the downstream-side end portion of the medium transported by adjusting the timing of liquid ejection from the nozzles based on the first pattern and second pattern.

In such a liquid ejection method, the first pattern and the second pattern may be formed close to each other. By forming the first pattern and the second pattern close to each other, the timing of liquid ejection from the nozzles can be adjusted in a simple manner.

In such a liquid ejection method, as the first pattern, a plurality of first patterns may be formed with the liquid ejected from the nozzles at respective timings in which the predetermined interval differs from each other, and as the second pattern, a plurality of second patterns may each be formed corresponding to each of the plurality of first patterns. In this manner, if, as the first pattern, the plurality of first patterns are formed with the liquid ejected from the nozzles at the respective timings in which the predetermined interval differs from each other, and if, as the second pattern, the plurality of second patterns are each formed corresponding to each of the plurality of first patterns, it is possible to adjust the timing of liquid ejection from the nozzles more properly. Through this, it is possible to suppress deterioration in the image quality in the upstream-side end portion or the downstream-side end portion of the medium transported.

In such a liquid ejection method, a transport section may carry out a transport operation for transporting the medium along a predetermined direction, the nozzles may carry out a liquid ejection operation in which the nozzles eject the liquid onto the medium while moving relative to the medium, during a period between the transport operations carried out by the transport section, and the first pattern and the second pattern may be formed each time the liquid ejection operation is carried out by the nozzles. In this manner, by forming the first pattern and the second pattern each time the liquid ejection operation is carried out in which liquid is ejected onto the medium from the nozzles that are moving relative to the medium, it is possible to adjust the timing of liquid ejection from the nozzles more properly. Through this, it is possible to suppress deterioration in the image quality in the upstream-side end portion or the downstream-side end portion of the medium transported.

In such a liquid ejection method, as the nozzles, a plurality of nozzles lined up along the predetermined direction may be provided, the plurality of nozzles may be divided into a plurality of groups, and the first pattern and the second pattern may be formed for each of the plurality of groups. In this manner, by dividing the plurality of nozzles lined up in the predetermined direction into the plurality of groups and forming the first pattern and the second pattern for each group, it is possible to adjust the timing of liquid ejection from the nozzles more properly. Through this, it is possible to suppress deterioration in the image quality in the upstream-side end portion or the downstream-side end portion of the medium transported.

In such a liquid ejection method, the nozzles may form an image on the medium by ejecting the liquid onto the medium based on data of the image, and the timing to eject the liquid from the nozzles may be changed using, in the data of the image, dummy pixel data as data of a pixel that constitutes the image. In this manner, by changing the timing of liquid ejection from the nozzles using, in the data of the image, dummy pixel data as data of the pixels that constitute the image, the timing of liquid ejection from the nozzles can be adjusted in a simple manner.

In such a liquid ejection method, ink may be ejected from the nozzles as the liquid. In this manner, if ink is ejected from the nozzles in the form of liquid, it is possible to suppress deterioration in the image quality in the upstream-side end portion or the downstream-side end portion of the medium transported.

A liquid ejection apparatus, including:

(A) nozzles that eject liquid onto a medium while moving back and forth relative to the medium, (B) a controller that when the first pattern has been formed on the medium with the liquid ejected from the nozzles at a timing delayed from a certain reference timing by a predetermined interval while the nozzles are moving in a certain direction with respect to the medium, forms a second pattern on the medium with the liquid ejected from the nozzles at a timing delayed from the certain reference timing by an interval equal to the predetermined interval, while the nozzles are moving in a direction opposite to the certain direction with respect to the medium, and when the first pattern has been formed on the medium with the liquid ejected from the nozzles at a timing preceding a certain reference timing by the predetermined interval while the nozzles are moving in the certain direction with respect to the medium, forms the second pattern on the medium with the liquid ejected from the nozzles at a timing preceding the certain reference timing by an interval equal to the predetermined interval, while the nozzles are moving in the direction opposite to the certain direction with respect to the medium.

Overview of Liquid Ejection Apparatus

Figure 2:
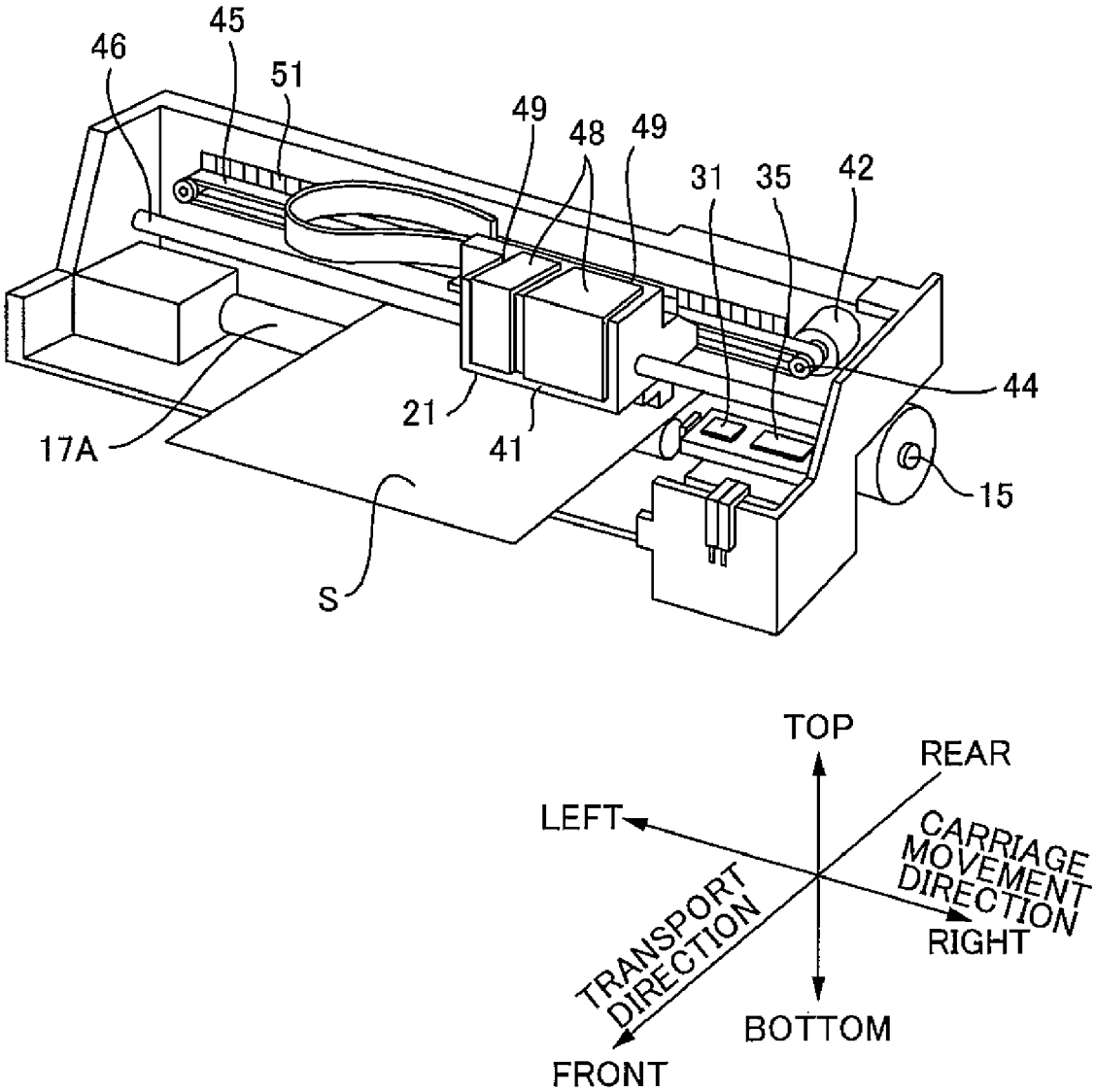
FIG. 2 is a perspective view illustrating an internal configuration of the liquid ejection apparatus (printing apparatus).
Figure 3:
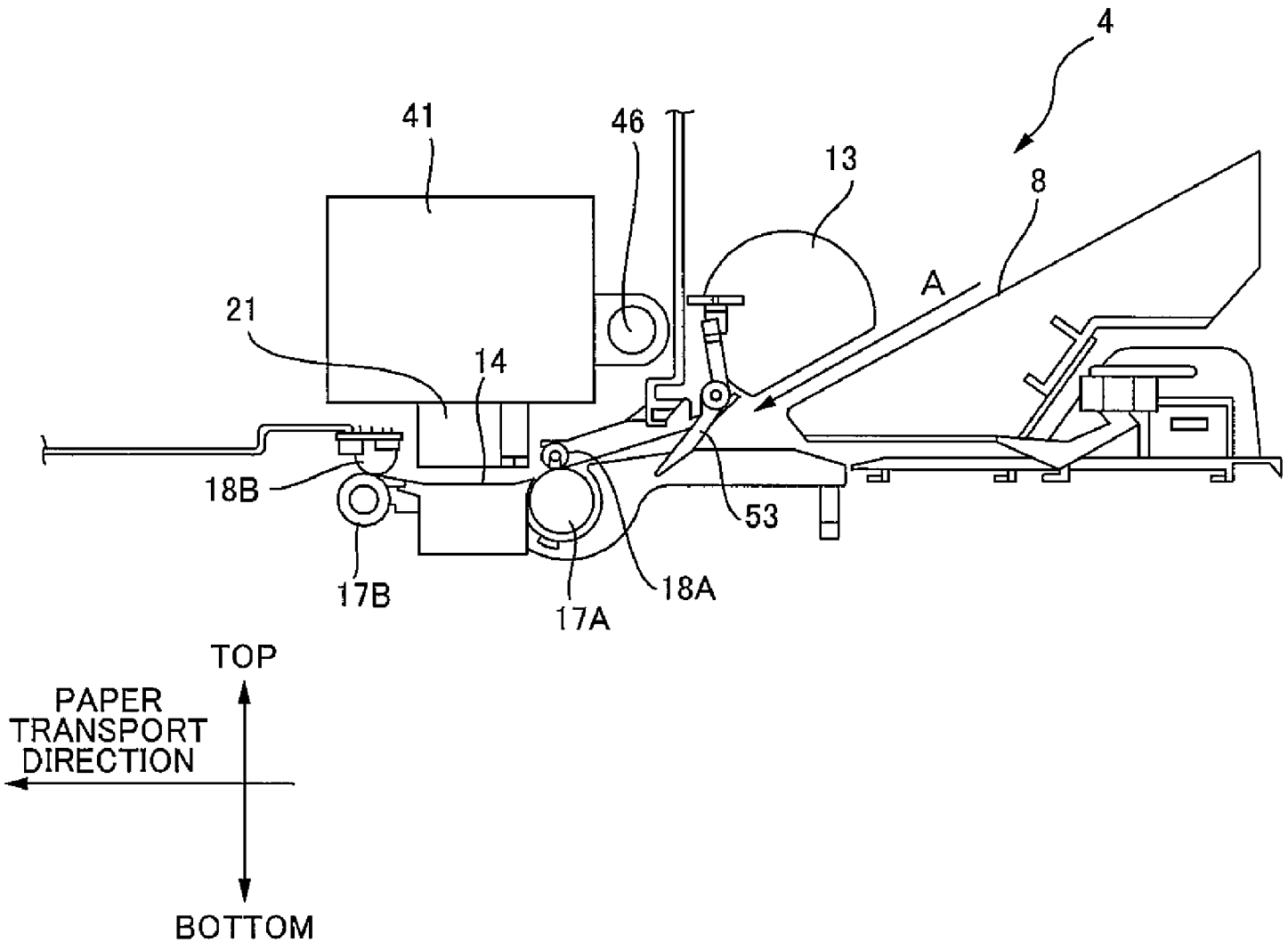
FIG. 3 is a cross-sectional view showing a transport section of the liquid ejection apparatus (printing apparatus).
Figure 4:
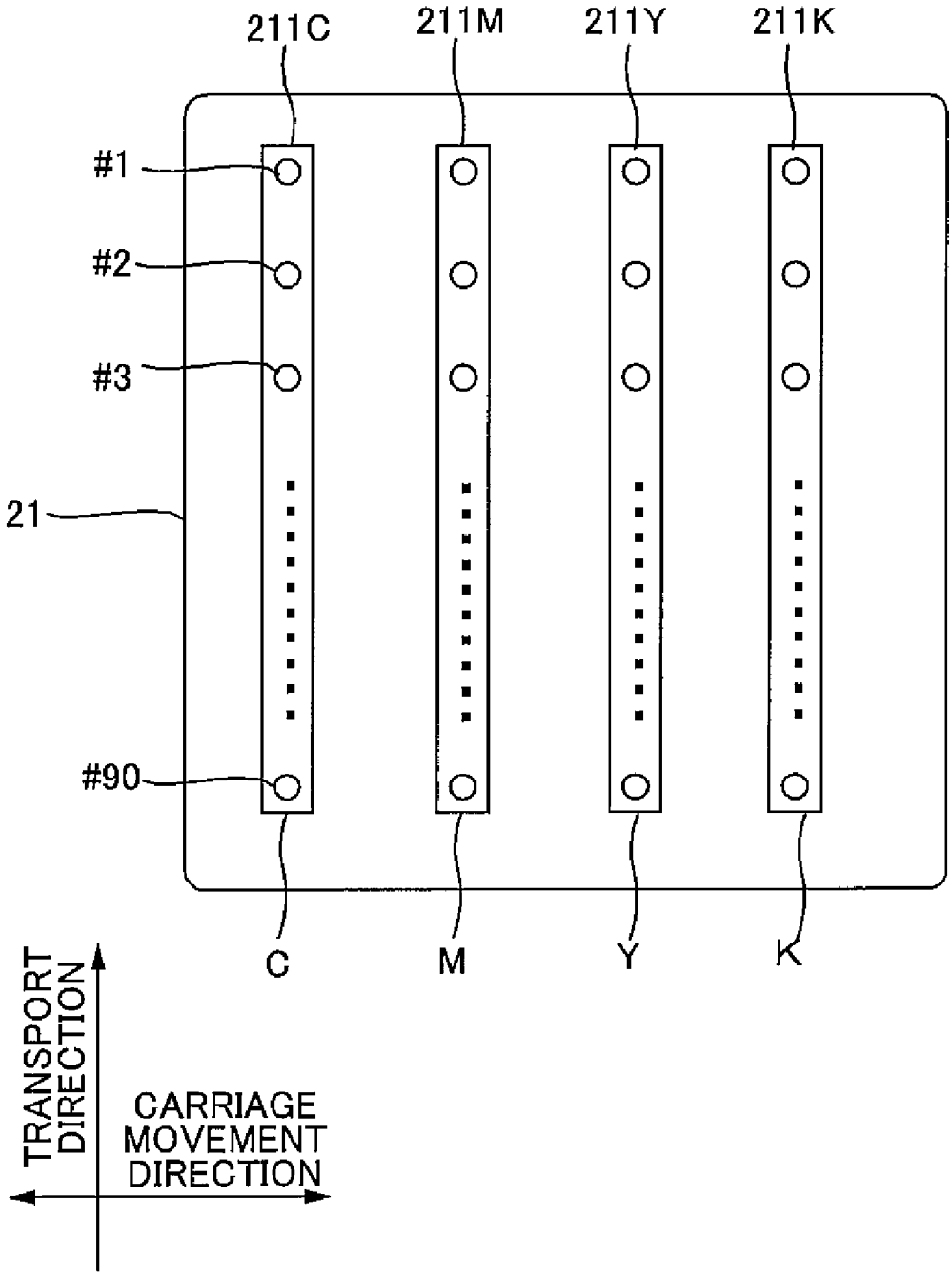
FIG. 4 is an explanatory diagram showing a nozzle arrangement of a head.
Figure 5:
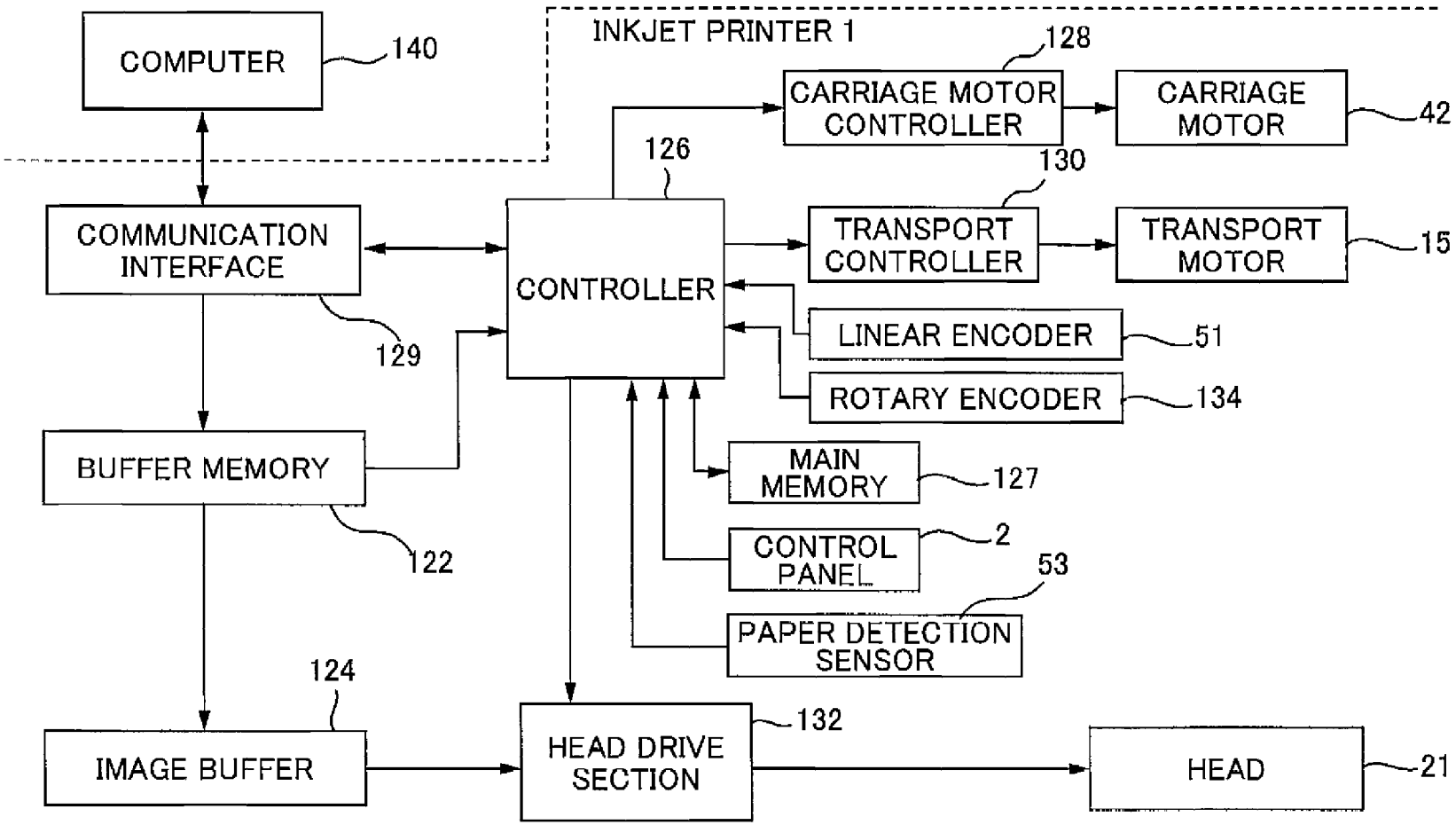
FIG. 5 is a block diagram showing a system configuration of the liquid ejection apparatus (printing apparatus).

A liquid ejection apparatus according to the present embodiment is described below. In this description, an inkjet printer 1, which is a printing apparatus that performs printing by ejecting ink onto a medium, is used as an example of the liquid ejection apparatus. FIGS. 1 to 3 illustrate the inkjet printer 1. FIG. 1 shows the appearance of the inkjet printer 1. FIG. 2 shows the internal configuration of the inkjet printer 1. FIG. 3 illustrates the configuration of a transport section of the inkjet printer 1. FIG. 4 shows the nozzles of the inkjet printer 1. FIG. 5 illustrates the system configuration of the inkjet printer 1.

As shown in FIG. 1, the inkjet printer 1 is provided with a structure in which a medium such as print paper that is supplied from the rear face is discharged from the front face. The front face portion is provided with a control panel 2 and a paper discharge section 3. The rear face portion is provided with a paper supply section 4. The control panel 2 is provided with various types of control buttons 5 and display lamps 6. Furthermore, the paper discharge section 3 is provided with a paper discharge tray 7 that covers a paper discharge opening when the inkjet printer is not used. The paper supply section 4 is provided with a paper supply tray 8 for holding a medium such as cut paper.

As shown in FIG. 2, a carriage 41 is provided in an internal portion of the inkjet printer 1. The carriage 41 is arranged such that it can move relatively in the right-to-left direction. A carriage motor 42, a pulley 44, a timing belt 45, and a guide rail 46 are arranged in the vicinity of the carriage 41. The carriage motor 42 is constituted by a DC motor or the like and functions as a driving power source for moving the carriage 41 relatively along the right-to-left direction (hereinafter, also referred to as a carriage movement direction). The timing belt 45 is connected via the pulley 44 to the carriage motor 42, and a part of the timing belt 45 is also connected to the carriage 41, such that the carriage 41 is moved relatively along the carriage movement direction (right-to-left direction) due to the rotational drive of the carriage motor 42. The guide rail 46 guides the carriage 41 along the carriage movement direction (right-to-left direction).

In addition, a linear encoder 51 that detects a position of the carriage 41, a transport roller 17A for transporting a medium S in a direction intersecting a movement direction of the carriage 41 (front-to-rear direction in FIG. 2, hereinafter also referred to as a transport direction), and a transport motor 15 that rotatably drives the transport roller 17A are provided in the vicinity of the carriage 41.

On the other hand, the carriage 41 is provided with ink cartridges 48 that contain various types of ink and a head 21 that carries out printing on the medium S. The ink cartridges 48 contain inks of various colors such as yellow (Y), magenta (M), cyan (C), and black (K) for example, and are removably mounted in a cartridge mounting section 49 provided in the carriage 41. Furthermore, in this embodiment, the head 21 carries out printing by ejecting ink onto the medium S. For this reason, the head 21 is provided with a large number of nozzles for ejecting ink.

In addition to the above, the internal portion of the inkjet printer 1 is provided with, for example, a pump device 31 for sucking ink from the nozzles such that clogging in the nozzles of the head 21 is eliminated, and a capping device 35 for capping the nozzles of the head 21 when printing is not being performed (when being on standby, for example) such that clogging in the nozzles of the head 21 is prevented.

The following is a description concerning the transport section of the inkjet printer 1. As shown in FIG. 3, the transport section is provided with a paper supply roller 13, a paper detection sensor 53, the transport roller 17A, a paper discharge roller 17B, a platen 14, and free rollers 18A and 18B.

The medium S to be printed is set in the paper supply tray 8. The medium S that has been set in the paper supply tray S is transported along the arrow A direction in the figure by the paper supply roller 13, which has a substantially D-shaped cross-section, and the medium S is sent into the internal portion of the inkjet printer 1. The medium S that has been sent into the internal portion of the inkjet printer 1 is brought into contact with the paper detection sensor 53. This paper detection sensor 53 is positioned between the paper supply roller 13 and the transport roller 17A, so that the paper detection sensor 53 detects the medium S that has been supplied by the paper supply roller 13.

The medium S that has been detected by the paper detection sensor 53 is gradually transported by the transport roller 17A to the platen 14 on which printing is performed. The free roller 18A is disposed at a position opposed to the transport roller 17A. The medium S is held between the free roller 18A and the transport roller 17A so that the medium S is smoothly transported.

The medium S that has been sent onto the platen 14 is gradually printed with ink ejected from the head 21. The platen 14 is disposed opposing the head 21 and supports the medium S that is being printed at the rear side of the medium.

The medium S on which printing has been performed is gradually discharged by the paper discharge roller 17B to the outside of the printer. The paper discharge roller 17B is driven in synchronization with the transport motor 15, and discharges the medium S to the outside of the printer by holding the medium S between the paper discharge roller 17B and the free roller 18B that is disposed opposing this paper discharge roller 17B.

It should be noted that in the present embodiment, the rear end portion of the medium S is referred to as an "upstream-side end portion" and the front end portion of the medium S is referred to as a "downstream-side end portion".

Head

FIG. 4 is a diagram showing the arrangement of the ink nozzles provided in the bottom face of the head 21. As shown in the figure, the bottom face of the head 21 is provided with nozzle rows each constituted by a plurality of nozzles #1 to #90, which respectively correspond to the colors of yellow (Y), magenta (M), cyan (C), and black (K), namely, a cyan nozzle row 211C, a magenta nozzle row 211M, a yellow nozzle row 211Y, and a black nozzle row 211K.

The nozzles #1 to #90 in each of the nozzle rows 211C, 211M, 211Y, and 211K are arranged in one straight line at intervals along a predetermined direction (transport direction of the medium S in this embodiment). The nozzle rows 211C, 211M, 211Y, and 211K are arranged in parallel at intervals along the movement direction of the head 21. Each of the nozzles ∩1 to #90 is provided with a piezo element (not shown) as a drive element for ejecting ink droplets.

When a voltage of a predetermined duration is applied between electrodes provided at both sides of the piezo element, the piezo element extends in accordance with the duration of the voltage application and deforms a lateral wall of the ink channel. Accordingly, the volume of the ink channel is constricted according to the extension and contraction of the piezo element, and ink corresponding to this amount of constriction becomes an ink droplet and is ejected from the nozzles #1 to #90 of the respective color nozzle rows 211C, 211M, 211Y, and 211K.

System Configuration

The following is a description concerning the system configuration of the inkjet printer 1. As shown in FIG. 5, the inkjet printer 1 is provided with a buffer memory 122, an image buffer 124, a controller 126, a main memory 127, a communication interface 129, a carriage motor controller 128, a transport controller 130, and a head drive section 132.

The communication interface 129 is used such that the inkjet printer 1 exchanges data with an external computer 140 such as a personal computer for example. The communication interface 129 is connected to the external computer 140 so as to enable wired or wireless communications, and receives various types of data such as print data transmitted from the computer 140.

Various types of data such as print data received by the communication interface 129 is temporarily stored in the buffer memory 122. Furthermore, the print data stored in the buffer memory 122 is sequentially stored in the image buffer 124. The print data stored in the image buffer 124 is sequentially sent to the head drive section 132. Furthermore, the main memory 127 is constituted by a ROM, a RAM, or an EEPROM, for example. Various programs for controlling the inkjet printer 1 and various types of setting data, for example, are stored in the main memory 127.

The controller 126 reads out a control program and various types of setting data from the main memory 127, and performs the overall control of the inkjet printer 1 in accordance with the control program and the various types of setting data. Furthermore, detection signals from various sensors such as a rotary encoder 134, the linear encoder 51, and the paper detection sensor 53 are input to the controller 126.

When various types of data such as print data that has been sent from the external computer 140 is received by the communication interface 129 and is stored in the buffer memory 122, the controller 126 reads out necessary information from among the stored data from the buffer memory 122. Based on the information that is read out, the controller 126 controls each of the carriage motor controller 128, the transport controller 130, and the head drive section 132, for example, in accordance with a control program while referencing output from the linear encoder 51 and the rotary encoder 134.

The carriage motor controller 128 controls the drive of the carriage motor 42, such as the rotation direction, the number of rotations and the torque of the carriage motor 42 in accordance with instructions from the controller 126. The transport controller 130 controls, for example, the transport motor 15 for rotationally driving the transport roller 17A in accordance with instructions from the controller 126.

The head drive section 132 controls the drive of the color nozzles provided to the head 21 in accordance with instructions from the controller 126 and based on print data stored in the image buffer 124.

Drive Circuit

Figure 6:
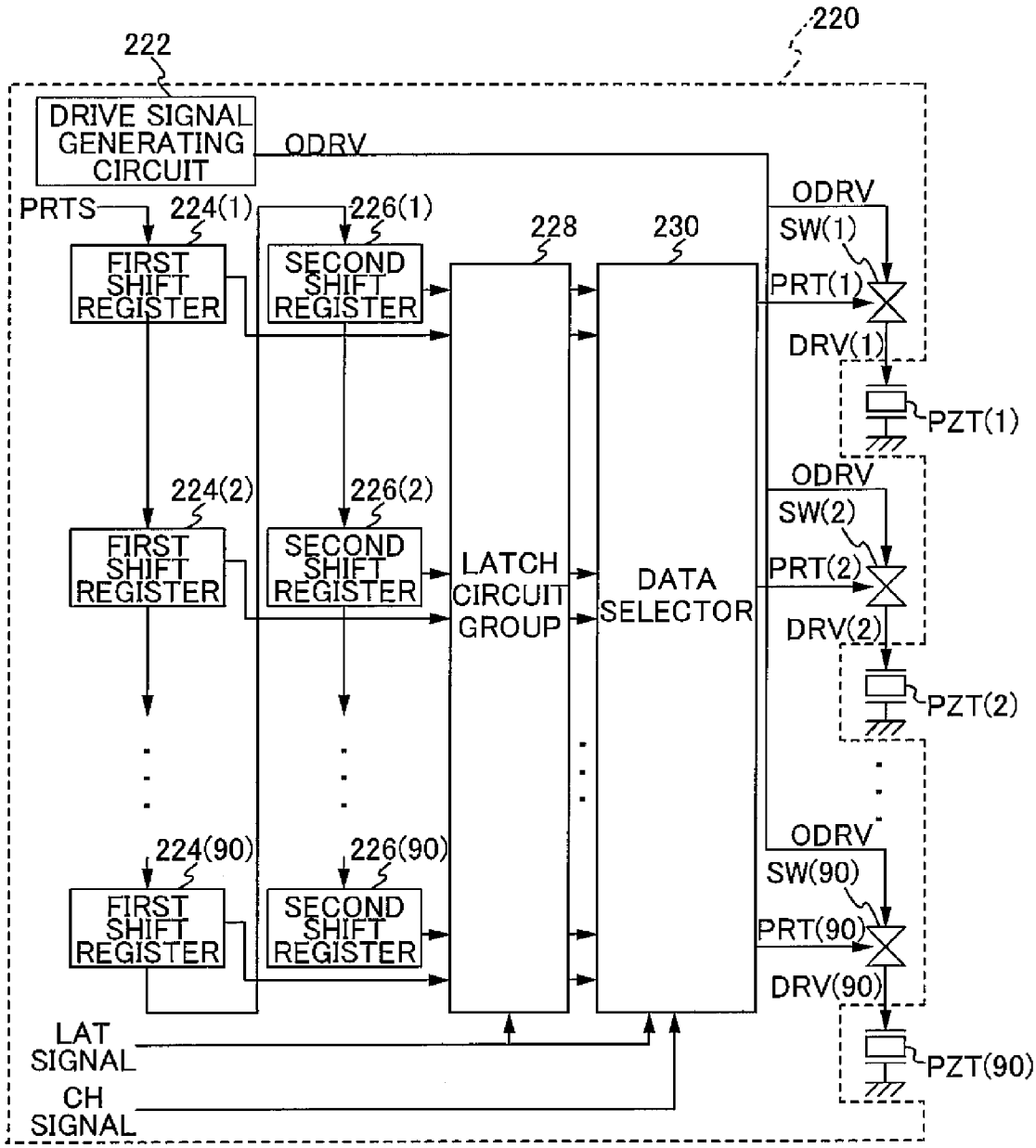
FIG. 6 illustrates an exemplary drive circuit.
Figure 7:
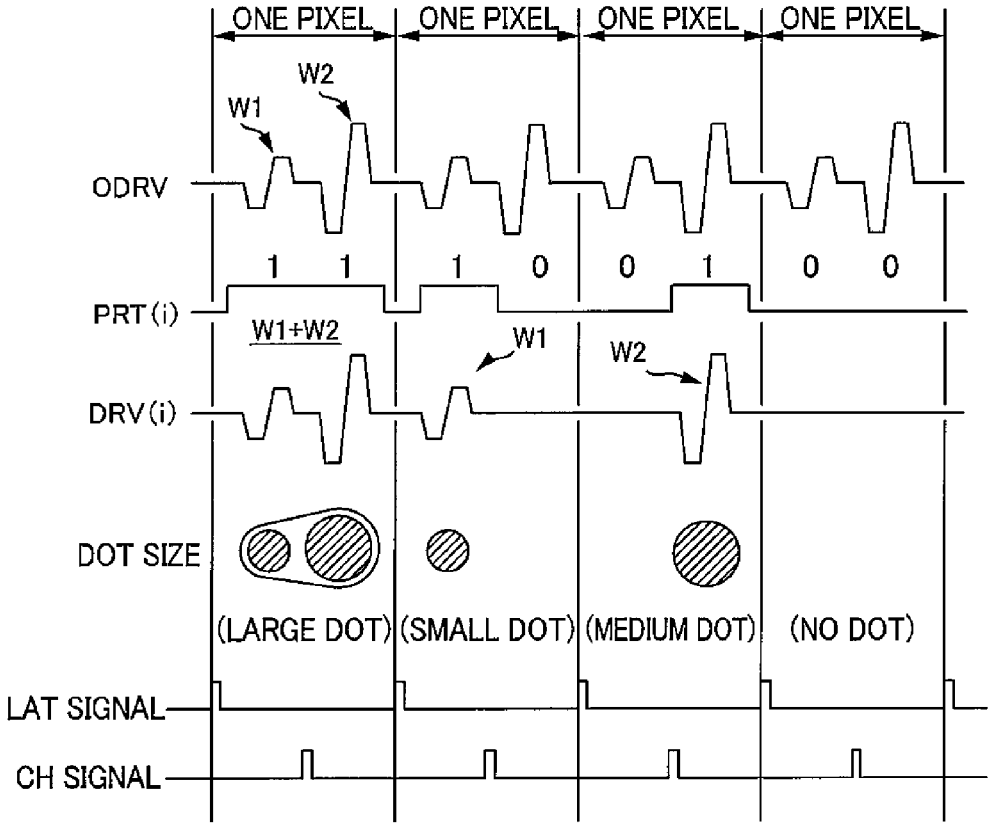
FIG. 7 is a timing chart illustrating respective signals generated in the drive circuit.

FIG. 6 shows an example of a drive circuit 220 of the head 21. Furthermore, FIG. 7 is a timing chart illustrating respective signals generated in the drive circuit 220.

The drive circuit 220 is provided for ejecting ink from the nozzles #1 to #90 provided to the head 21, and drives 90 piezo elements PZT(1) to (90) provided respectively corresponding to the nozzles #1 to #90. The piezo elements PZT(1) to (90) are driven based on a print signal PRTS that is input to this drive circuit 220. In the figure, the numbers in parentheses indicated at the end of the signals or components denote the nozzle numbers 1 to 90 corresponding to the signals or components.

In this embodiment, this drive circuit 220 is provided separately for each of the nozzle groups 211Y, 211M, 211C, and 211K that are provided to the head 21. That is to say, four drive circuits 220 are provided respectively corresponding to the yellow nozzle group 211Y, the magenta nozzle group 211M, the cyan nozzle group 211C, and the black nozzle group 211K.

The configuration of the drive circuit 220 is described. As shown in FIG. 6, the drive circuit 220 is provided with a drive signal generating circuit 222 for generating a drive signal ODRV, 90 first shift registers 224 (1) to (90), 90 second shift registers 226(1) to (90), a latch circuit group 228, a data selector 230, and 90 switches SW(1) to (90).

The drive signal generating circuit 222 generates a drive signal ODRV that is applied in common to the nozzles #1 to #90. The drive signal ODRV is a signal for driving the piezo elements PZT(1) to (90) provided respectively corresponding to the nozzles #1 to #90. As shown in FIG. 7, the drive signal ODRV is a signal that has a plurality of pulses, that is, a first pulse W1 and a second pulse W2 in this case, in a time period for one pixel (within a time during which the carriage 41 passes through the interval for one pixel). In the drive signal ODRV, the plurality of pulses (first pulse W1 and second pulse W2) are repeatedly generated on a predetermined cycle. The drive signal ODRV generated by the drive signal generating circuit 222 is output toward the switches SW(1) to (90).

On the other hand, the print signal PRTS (see FIG. 6) is a data signal including 90 sets of 2-bit data for driving the piezo elements PZT (1) to (90), and is a signal that instructs, for example, whether or not ink is to be ejected from the nozzles #1 to #90 and the size of ink to be ejected. The print signal PRTS is serially transmitted to the drive circuit 220, and is input to the 90 first shift registers 224(1) to (90). Then, the print signal PRTS is input to the second shift registers 226(1) to (90). Herein, a first bit data of each of the 90 sets of 2-bit data is input to each of the first shift registers 224(1) to (90). Furthermore, a second bit data of each of the 90 sets of 2-bit data is input to each of the second shift registers 226(1) to (90).

The latch circuit group 228 latches data stored in the first shift registers 224(1) to (90) and the second shift registers 226(1) to (90), and obtains the data as signals indicating "0 (low)" or "1 (high)". Then, the latch circuit group 228 outputs to the data selector 230 the signals extracted based on data stored in the first shift registers 224(1) to (90) and the second shift registers 226(1) to (90). The latch timing of the latch circuit group 228 is controlled by a latch signal (LAT) that is input to this latch circuit group 228. More specifically, if a pulse as shown in FIG. 7 as a latch signal (LAT) is input to the latch circuit group 228, then the latch circuit group 228 latches data stored in the first shift registers 224(1) to (90) and the second shift registers 226(1) to (90). The latch circuit group 228 latches data every time a pulse is input as a latch signal (LAT).

On the other hand, the data selector 230 selects signals corresponding to either one of the first shift registers 224(1) to (90) and the second shift registers 226(1) to (90), from among the signals (signals indicating "0 (low)" or "1 (high)") that are output from the latch circuit group 228, and outputs the selected signals as print signals PRT(1) to (90) respectively to the switches SW(1) to (90). The signals selected by the data selector 230 are switched based on both of a latch signal (LAT signal) and a change signal (CH signal) that are input to this data selector 230.

Here, if a pulse shown in FIG. 7 as a latch signal (LAT signal) is input to the data selector 230, then the data selector 230 selects signals corresponding to data stored in the second shift registers 226(1) to (90), and outputs the selected signals as print signals PRT(1) to (90) respectively to the switches SW(1) to (90). Furthermore, if a pulse shown in FIG. 7 as a change signal (CH signal) is input to the data selector 230, then the data selector 230 switches signals to be selected from the signals corresponding to data stored in the second shift registers 226(1) to (90) to the signals corresponding to data stored in the first shift registers 224(1) to (90), and outputs the selected signals as print signals PRT(1) to (90) respectively to the switches SW(1) to (90). Then, when a pulse as a latch signal (LAT signal) is input again, then the data selector 230 switches signals to be selected from the signals corresponding to data stored in the first shift registers 224(1) to (90) to the signals corresponding to data stored in the second shift registers 226(1) to (90), and outputs the selected signals as print signals PRT(1) to (90) respectively to the switches SW(1) to (90).

As shown in FIG. 7, a pulse is generated in a latch signal (LAT signal) per cycle of one pixel unit. Furthermore, as shown in FIG. 7, a pulse is generated in a change signal (CH signal), the generation timing of which is in the middle of the one pixel cycle. Accordingly, 2-bit data sets each corresponding to one pixel are serially transmitted to the switches SW(1) to (90). More specifically, 2-bit data such as "00", "01", "10", and "11" is input to the switches SW(1) to (90) as print signals PRT(1) to (90) in each one pixel cycle.

The switches SW(1) to (90) determine whether or not to cause the drive signal ODRV that has been input from the drive signal generating circuit 222 to pass through, based on the print signals PRT(1) to (90) output from the data selector 230, that is, 2-bit data such as "00", "01", "10", and "11". More specifically, if the level of a print signal PRT(i) is "1 (high)", then a drive pulse (first pulse W1 or second pulse W2) corresponding to the drive signal ODRV is caused to pass through so as to serve as a real drive signal DRV(i). On the other hand, if the level of a print signal PRT (i) is "0 (low)", then the switches SW(1) to (90) block a drive pulse (first pulse W1 or second pulse W2) corresponding to the drive signal ODRV.

Accordingly, as shown in FIG. 7, the real drive signal DRV(i) that is input from switches SW(1) to (90) to the piezo elements PZT(1) to (90) varies in accordance with the print signals PRT (1) to (90) input from the data selector 230 to the switches SW(1) to (90), that is, 2-bit data such as "00", "01", "10", and "11".

PTS Signals

The latch signal (LAT signal) that is input to the latch circuit group 228 or the data selector 230 is generated based on a PTS (pulse timing signal) signal. In addition, the change signal (CH signal) is generated based on the latch signal (LAT signal) generated in this manner based on the PTS signal. The PTS signal is a signal that defines the timing at which pulses are generated in the latch signal (LAT signal) and the change signal (CH signal).

Figure 8:
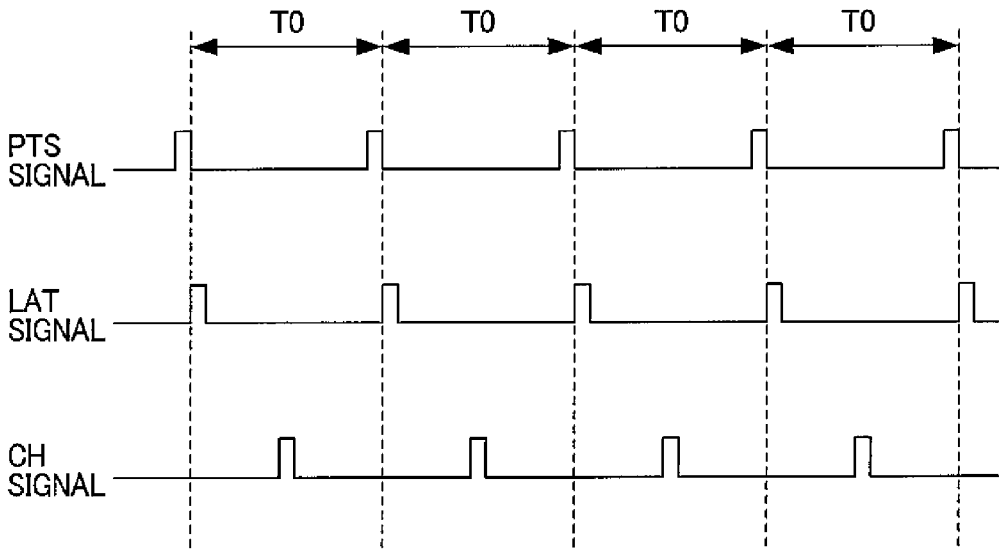
FIG. 8 illustrates the timing relationship of a PTS signal, a latch signal and a change signal.

FIG. 8 illustrates in detail the relationship of the timings of the PTS signal, the latch signal (LAT signal), and the change signal (CH signal). In the PTS signal, a pulse is generated on a predetermined cycle TO. In the latch signal (LAT signal), a pulse is generated immediately in response to the pulse generated in the PTS signal. Also, in the change signal (CH signal), a pulse is generated based on the pulse generated in the latch signal in this manner, specifically, at a timing delayed by a predetermined time after generation of the pulse in the latch signal. Pulses in the latch signal (LAT signal) and the change signal (CH signal) are generated every time a pulse is generated in the PTS signal.

The PTS signal is generated by the controller 126 in the present embodiment. The controller 126 generates the PTS signal based on the pulse output from the linear encoder 51. In other words, the PTS signal is generated in accordance with the amount that the carriage 41 has moved. The PTS signal that has been generated by the controller 126 is output to the head drive section 132. In the head drive section 132, the latch signal (LAT signal) is generated based on the PTS signal output from the controller 126. Also, the change signal (CH signal) is generated based on the latch signal (LAT signal), and the original drive signal ODRV is generated by the original drive signal generating circuit 222.

Conventional Problems

Incidentally, in the inkjet printer 1 as described above, in some cases it has been impossible to sufficiently prevent deterioration in the printed image quality in the upstream-side end portion of the transported medium S (this corresponds to the "rear end portion" of the medium S in the present embodiment) or the downstream-side end portion of the transported medium S (this corresponds to the "front end portion" of the medium S in the present embodiment). This is because the upstream-side end portion or the downstream-side end portion of the medium S is lifted a little when printing is performed on the upstream-side end portion or the downstream-side end portion of the medium S. The upstream-side end portion or the downstream-side end portion of the medium S is lifted a little from the printing position in this manner because the upstream-side end portion or the downstream-side end portion of the medium is positioned away from the transport roller 17A or the like that transports the medium S. That is, at an initial stage in which printing on the medium S is commenced, the downstream-side end portion of the medium S has not yet contacted the transport roller 17A or the like, and therefore the downstream-side end portion of the medium S is positioned away from the transport roller 17A or the like. For this reason, the downstream-side end portion of the medium S is sometimes lifted a little from the printing position when printing is performed on the downstream-side end portion of the medium S. Furthermore, when printing on the medium S is about to end, the upstream-side end portion of the medium S is positioned away from the transport roller 17A or the like. For this reason, when printing is performed on the upstream-side end portion of the medium S, the upstream-side end portion of the medium S is sometimes lifted a little from the printing position.

In this manner, when printing is performed on the upstream-side end portion or the downstream-side end portion of the medium S while the upstream-side end portion or the downstream-side end portion is lifted a little from the printing position, the gap between a printing surface of the medium S and the nozzles varies. When the gap between the printing surface of the medium S and the nozzles #1 to #90 varies, the landing position of the ink ejected from the nozzles #1 to #90 is displaced, which may invite deterioration in the image quality in the upstream-side end portion or the downstream-side end portion of the medium S. Recently, the movement speed of the carriage 41 has been significantly increased so as to improve the print processing speed. Therefore, the image quality deterioration due to variance in the gap between the printing surface of the medium S and the nozzles #1 to #90 has become an issue that cannot be neglected.

Gap between Head and Printing Surface

Figure 9A:
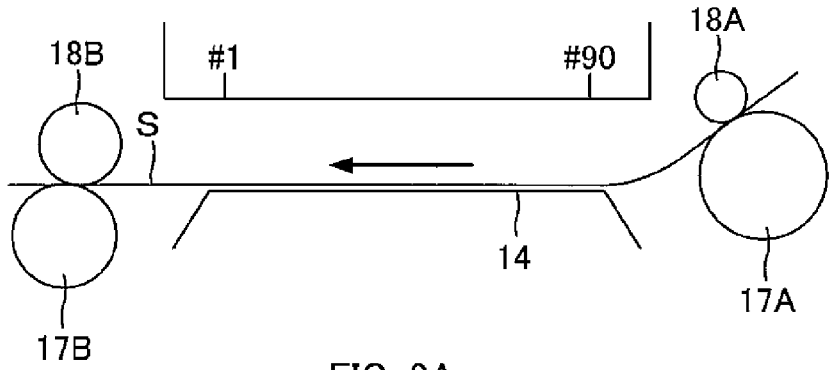
FIG. 9A illustrates a gap between a head and a printing surface when printing is performed on a medium.
Figure 9B:
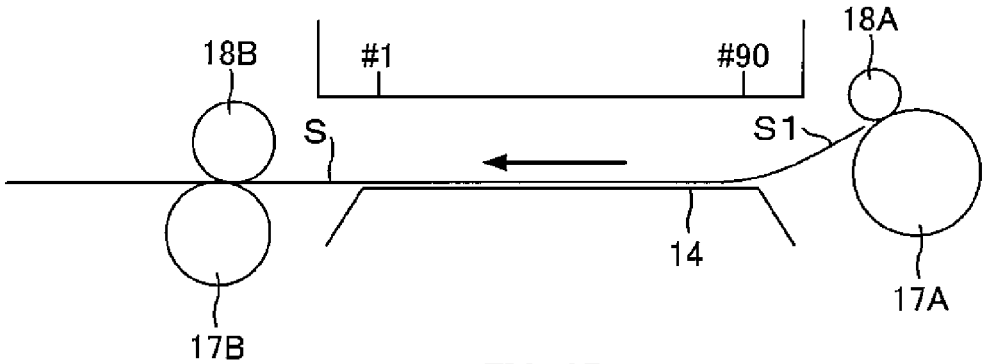
FIG. 9B illustrates a state in which an end portion of the medium has ceased to be secured by a transport roller.
Figure 9C:
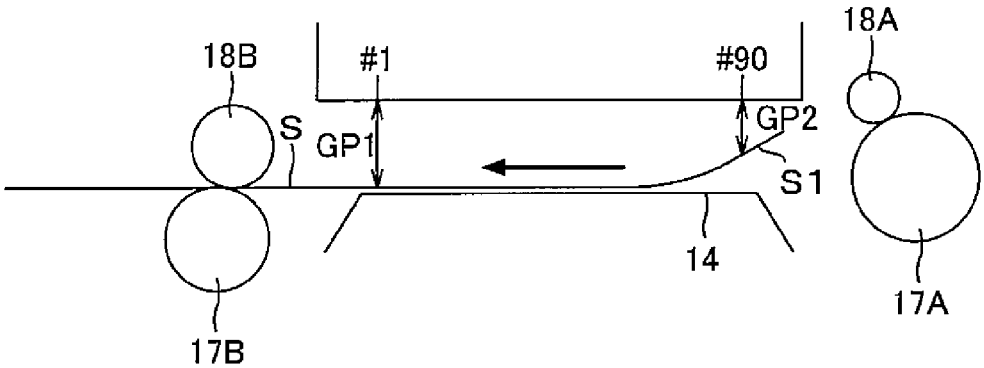
FIG. 9C illustrates a state in which printing is performed on the end portion of the medium that has ceased to be secured by the transport roller.

FIGS. 9A to 9C illustrate the gap between the head 21 and the printing surface when printing is performed on the medium S.

During printing, the medium S is sent to the platen 14 while being sandwiched between the transport roller 17A and the free roller 18A, which are provided on the upstream side with respect to the transport direction, as shown in FIG. 9A, and further gradually sent to the paper discharge side while being sandwiched between the discharge roller 17B and the free roller 18B, which are provided on the downstream side with respect to the transport direction.

Then, printing on the medium S proceeds and when an upstream-side end portion S1 of the medium S ceased to be secured between the transport roller 17A and the free roller 18A, the upstream-side end portion S1 of the medium S may become warped as shown in FIG. 9B. The medium S whose upstream-side end portion S1 is warped is transported to the paper discharge side by being sandwiched between the discharge roller 17B and the free roller 18B with the medium S being warped.

For this reason, there are cases in which the upstream-side end portion S1 of the medium S is still warped when it passes over the platen 14 disposed below the head 21. As shown in FIG. 9C, there are cases in which a gap GP2 between the head 21 and the printing surface of the medium S on the upstream side with respect to the transport direction differs from a gap SP1 between the head 21 and the printing surface of the medium S on the downstream side with respect to the transport direction. The gap GP2 between the head 21 and the printing surface of the medium S on the upstream side with respect to the transport direction is smaller than the gap GP1 between the head 21 and the printing surface of the medium S on the downstream side with respect to the transport direction, as a result of the upstream-side end portion S1 of the medium S being warped. For this reason, the landing position of the ink ejected from nozzles positioned on the upstream side with respect to the transport direction, the nozzle #90 for example, is displaced.

In particular, in the case where ink is ejected from each of the nozzles #1 to #90 while the carriage 41 is moved back and forth relative to the medium S, the position on the medium S where the ink ejected from the nozzles #1 to #90 lands when the carriage 41 is moving in a certain direction (while the carriage 41 is moving in a forward pass) is significantly displaced from the position on the medium S where the ink ejected from the nozzles #1 to #90 lands when the carriage 41 is moving in a direction opposite to the certain direction (while the carriage 41 is moving in a return pass).

It should be noted that in FIGS. 9A to 9C, a case is illustrated as an example in which the upstream-side end portion S1 of the medium S is warped. However, there are cases in which the downstream-side end portion (front end portion) of the medium S is warped in a similar manner.

Displacement of Ink Landing Position

Figure 10:
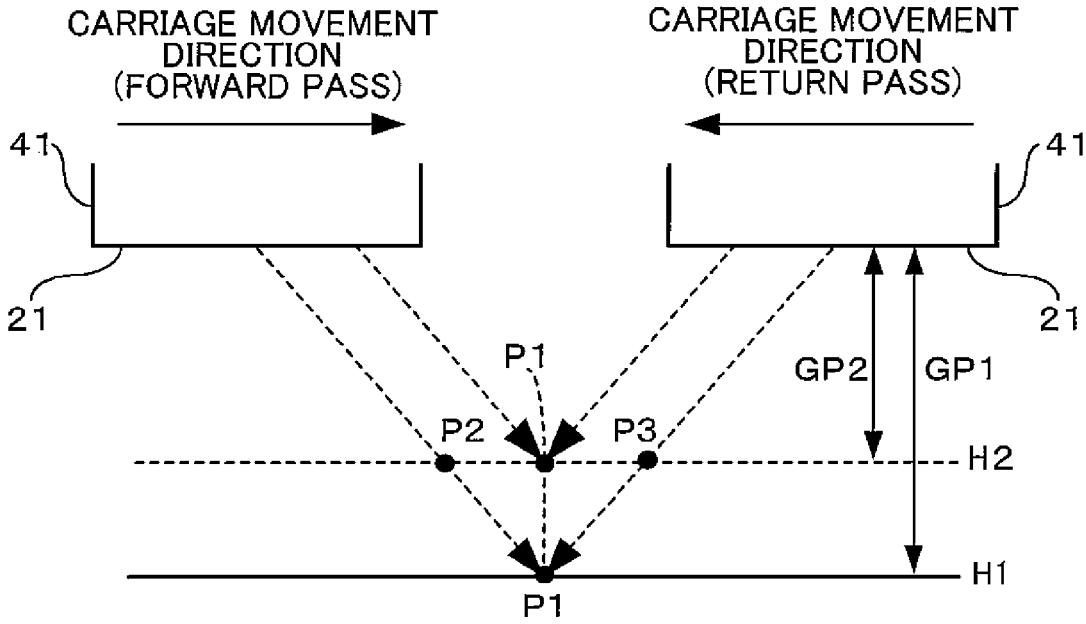
FIG. 10 illustrates displacement of the ink landing position during back and forth movement of a carriage.

FIG. 10 illustrates displacement of the ink landing position when the carriage 41 is moved back and forth.

Generally, a position on the medium S where the ink ejected from the nozzles #1 to #90 lands while the carriage 41 is moving in the certain direction, that is, rightward (forward pass) in this case for example, and a position on the medium S where the ink ejected from the nozzles #1 to #90 lands while the carriage 41 is moving in the direction opposite to the certain direction, that is, leftward (return pass) in this case for example, are adjusted such that the positions match at the point P1 based on the adjustment method called "Bi-d adjustment".

However, as described so far, when the upstream-side end portion S1 of the medium S is warped and lifted from the platen 14, the gap between the printing surface of the upstream-side end portion S1 of the medium S and the head 21 becomes smaller. Therefore the position on the medium S where the ink ejected from the nozzles #1 to #90 lands when the carriage 41 is moving in the certain direction, that is, rightward (forward pass) in this case for example, and the position on the medium S where the ink ejected from the nozzles #1 to #90 lands when the carriage 41 is moving in the direction opposite to the certain direction, that is, leftward (return pass) in this case for example, are displaced from each other, so that the positions do not match at the point P1. In other words, as shown in the figure, a position in the height direction of the medium S before gap variation is given as "H1". A position in the height direction of the medium S after the gap variation is given as "H2". Then, the position on the medium S where the ink ejected from the nozzles #1 to #90 lands while the carriage 41 is moving in the certain direction, that is, rightward (forward pass) in this case for example, is the point P2. On the other hand, the position on the medium S where the ink ejected from the nozzles #1 to #90 lands while the carriage 41 is moving in the direction opposite to the certain direction, that is, leftward (return pass) in this case for example, is the point P3.

In this manner, the position on the medium S (point P2) where the ink ejected from the nozzles #1 to #90 lands while the carriage 41 is moving in the certain direction, that is, rightward (forward pass) in this case for example, and the position on the medium S (point P3) where the ink ejected from the nozzles #1 to #90 lands while the carriage 41 is moving in the direction opposite to the certain direction, that is, leftward (return pass) in this case for example, are displaced from each other. Therefore, in order to match the landing positions at the point P1 and also at the height position "H2" of the medium S, another adjustment is required.

Adjusting Method

Accordingly, in the present embodiment, when printing is performed on the upstream-side end portion or the downstream-side end portion of the medium transported, it is necessary to adjust the ink landing position by shifting the ink ejection timings from the nozzles, in order to prevent the landing position of the ink ejected from the nozzles from being significantly displaced. In the present embodiment, a technique called "pixel shifting" is used to change the timing of ink ejection from the nozzles. This "pixel shifting" is described below in detail.

Outline of Pixel Shifting

Figure 11:
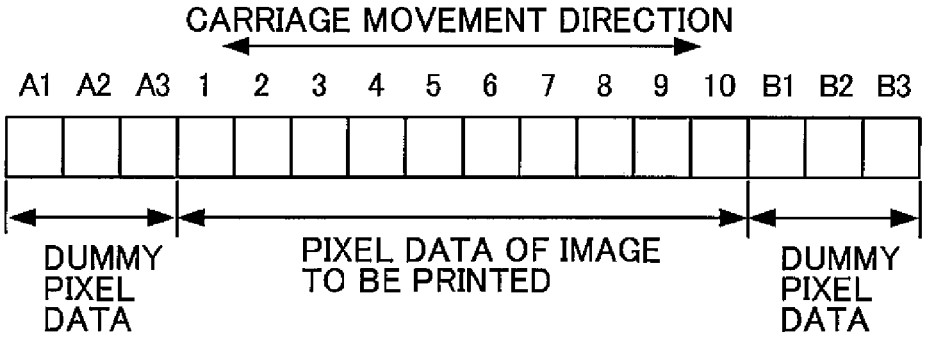
FIG. 11 illustrates "pixel shifting".
Figure 11:
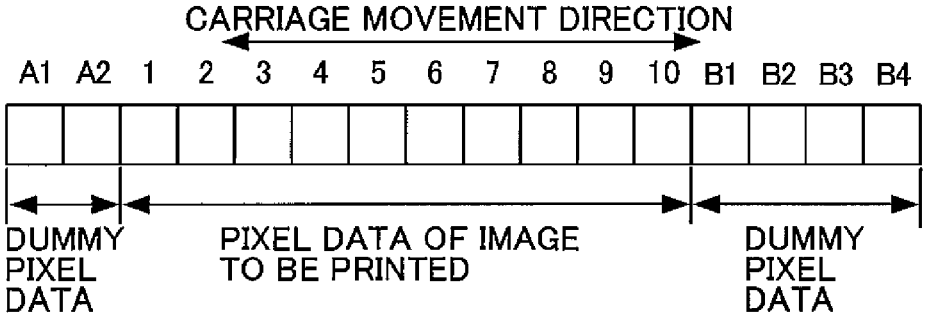
Figure 11:
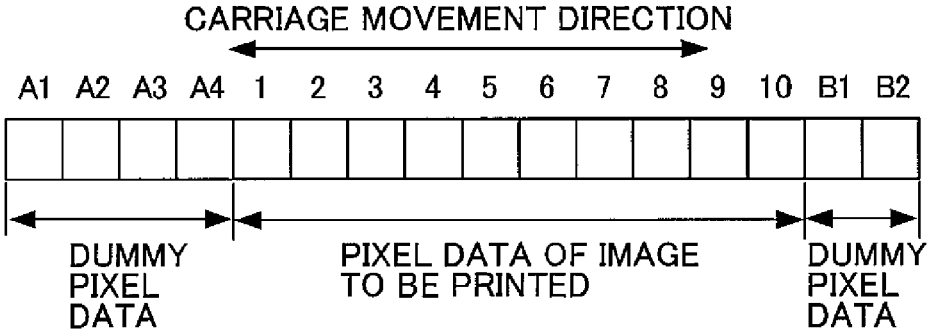

FIG. 11 illustrates an outline of "pixel shifting". In this "pixel shifting", the ink ejection timings from each of the nozzles #1 to #90 of the nozzle rows 211C, 211M, 211Y and 211K are adjusted by using, in data of an image to be printed, dummy pixel data as data of pixels that constitute the image. More specifically, as shown in the figure, dummy pixel data is added to the pixel data of the image to be printed, and ink is ejected from the nozzles #1 to #90 using the resultant data.

Here, dummy pixel data is added to each of the right and left sides of the pixel data of the image to be printed. As shown in (1) in the figure, in the case where pixel shifting is not performed, it is assumed for example that pieces of dummy pixel data corresponding to three pixels, A1 to A3 and B1 to B3, are respectively added to each of the right and left sides of the pixel data of the image to be printed.

Then, as shown in (2) in the figure for example, when the pixel data of the image to be printed are to be shifted leftward by an amount corresponding to a single pixel, pieces of dummy pixel data corresponding to two pixel, A1 and A2, are added to the left side of the pixel data of the image to be printed, while pieces of dummy pixel data corresponding to four pixel, B1 to B4, are added to the right side of the pixel data of the image to be printed. In this manner, the pixel data of the image to be printed can be shifted leftward by an amount corresponding to a single pixel. Through this, when ink is ejected from each of the nozzles #1 to #90 based on the resultant data, the timing of ink ejection from the nozzles #1 to #90 is shifted.

Furthermore, as shown in (3) in the figure for example, when the pixel data of the image to be printed is to be shifted rightward by an amount corresponding to a single pixel, pieces of dummy pixel data corresponding to four pixels, A1 to A4, are added to the left side of the pixel data of the image to be printed, while pieces of dummy pixel data corresponding to two pixels, B1 and B2, are added to the right side of the pixel data of the image to be printed. In this manner, the pixel data of the image to be printed can be shifted rightward by an amount corresponding to a single pixel. Through this, when ink is ejected from each of the nozzles #1 to #90 based on the resultant data, the timing of ink ejection from the nozzles #1 to #90 is shifted.

Actual Application Examples

Figure 12A:
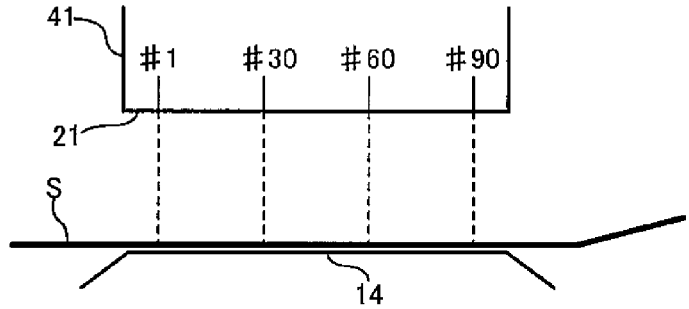
FIG. 12A illustrates a state in which an upstream-side end portion of a medium has not yet reached the area below nozzles #1 to #90.
Figure 12B:
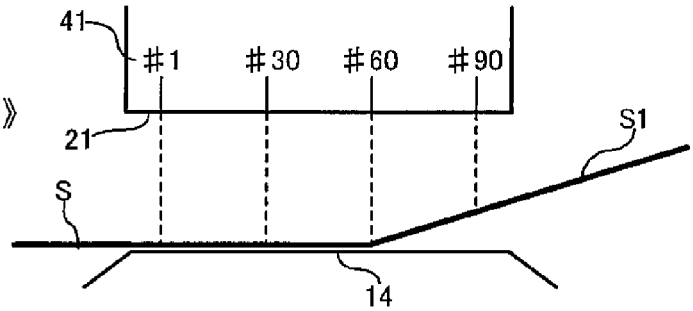
FIG. 12B illustrates a state in which the upstream-side end portion of the medium is present in the area below nozzles #61 to #90.
Figure 12C:
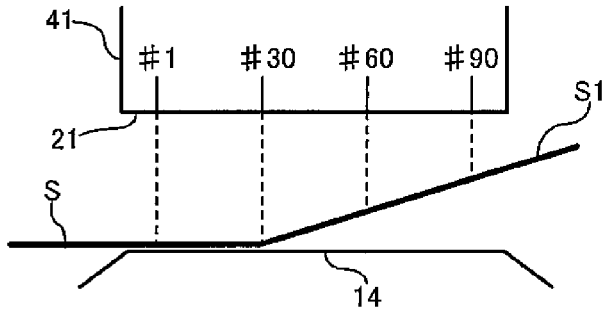
FIG. 12C illustrates a state in which the upstream-side end portion of the medium is present in the area below nozzles #31 to #90.
Figure 12D:
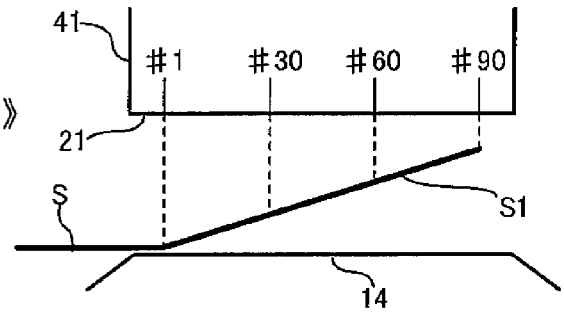
FIG. 12D illustrates a state in which the upstream-side end portion of the medium is present in the area below the nozzles #1 to #90.

FIGS. 12A to 12D illustrate exemplary arrangements between the medium S and the head 21. FIG. 12A illustrates a state in which the upstream-side end portion S1 of the medium S has not yet reached the area below the nozzles #1 to #90. FIG. 12B illustrates a state in which the upstream-side end portion S1 of the medium S is present in the area below the nozzles #61 to #90, FIG. 12C illustrates a state in which the upstream-side end portion S1 of the medium S is present in the area below the nozzles #31 to #90, and FIG. 12D illustrates a state in which the upstream-side end portion S1 of the medium S is present in the area below the nozzles #1 to #90.

Figure 13A:
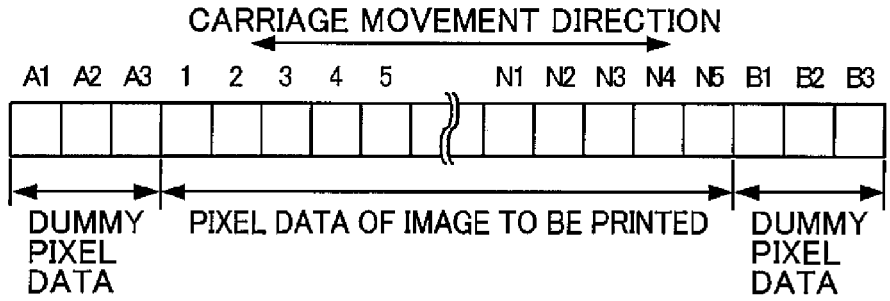
FIG. 13A illustrates an example of "pixel shifting" corresponding to the state in FIG. 12A.
Figure 13B:
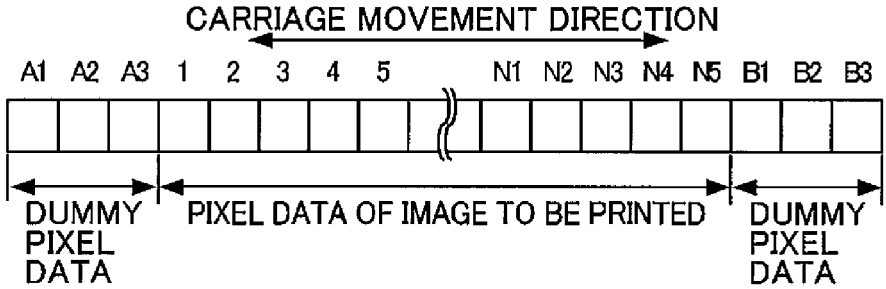
FIG. 13B illustrates an example of "pixel shifting" corresponding to the state in FIG. 12B.
Figure 13B:
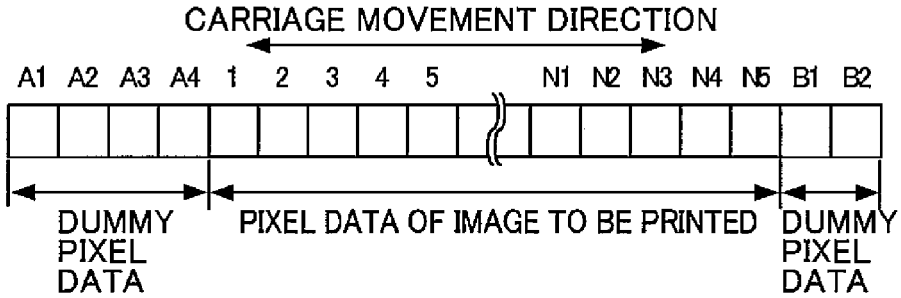
Figure 13B:
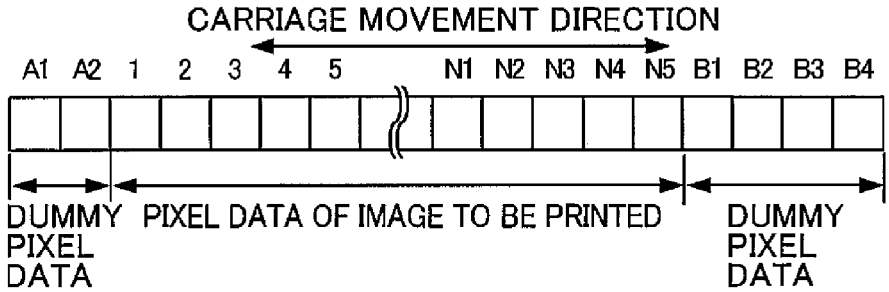
Figure 13C:
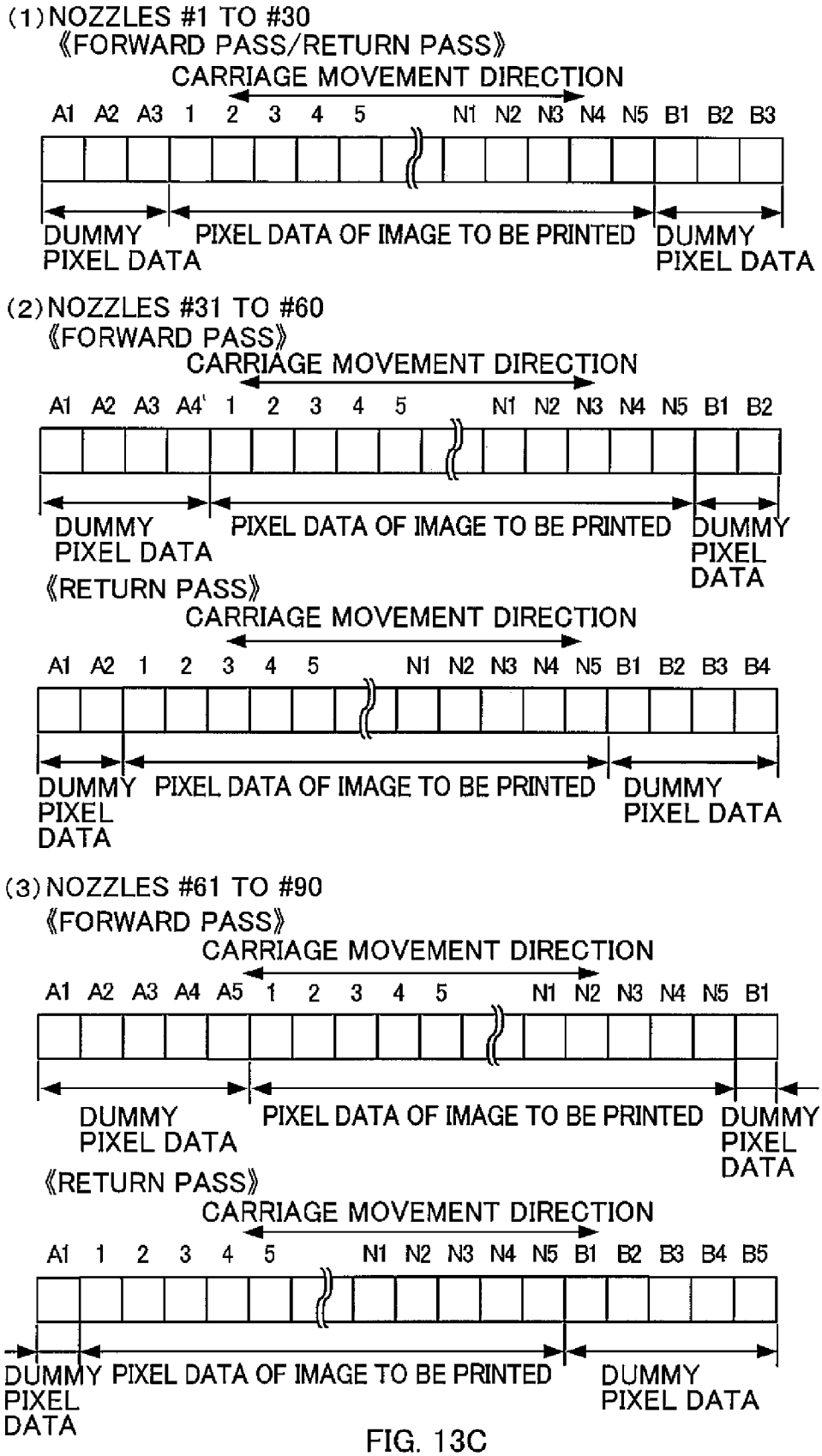
FIG. 13C illustrates an example of "pixel shifting" corresponding to the state in FIG. 12C.
Figure 13D:
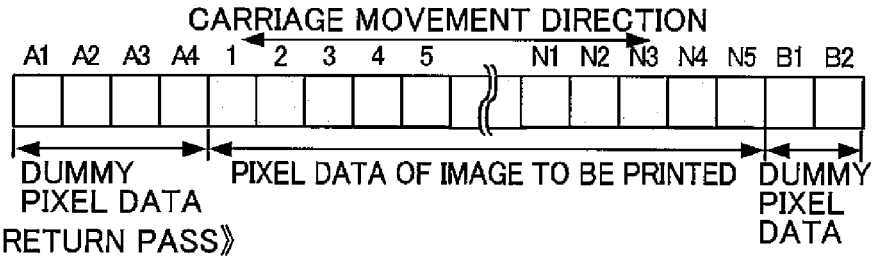
FIG. 13D illustrates an example of "pixel shifting" corresponding to the state in FIG. 12D.
Figure 13D:
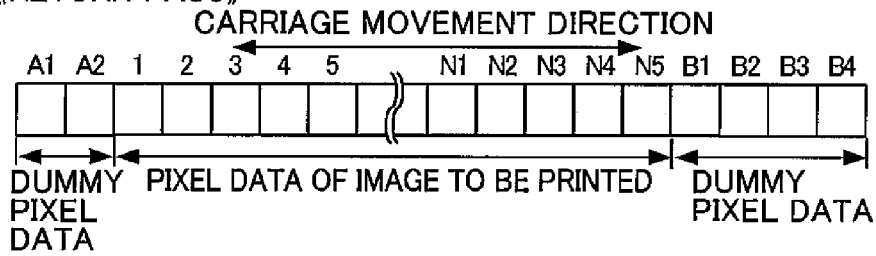
Figure 13D:
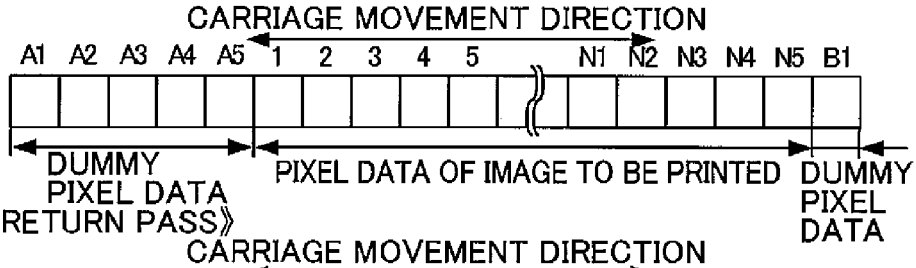
Figure 13D:
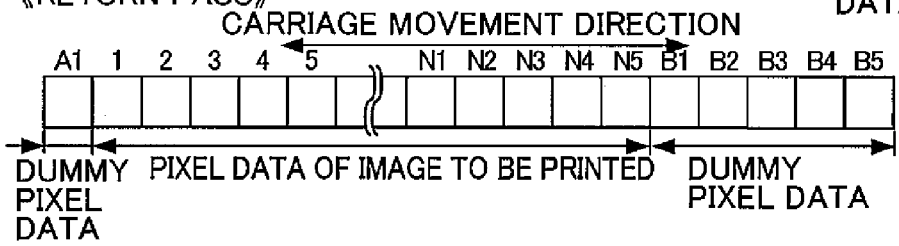
Figure 13D:
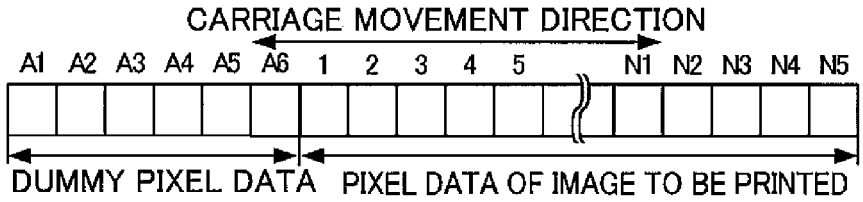
Figure 13D:
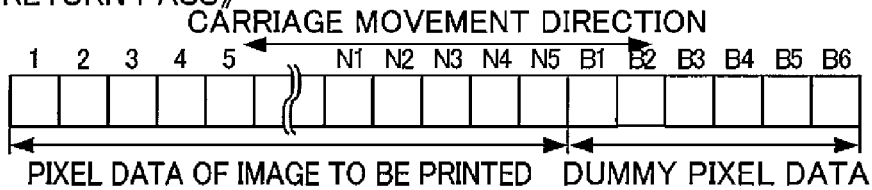

FIGS. 13A to 13D each illustrate an example of "pixel shifting" for each of the arrangement examples shown in FIGS. 12A to 12D. FIG. 13A illustrates an example of "pixel shifting" corresponding to the state in FIG. 12A, FIG. 13B illustrates an example of "pixel shifting" corresponding to the state in FIG. 12B, FIG. 13C illustrates an example of "pixel shifting" corresponding to the state in FIG. 12C, and FIG. 13D illustrates an example of "pixel shifting" corresponding to the state in FIG. 12D.

In the present embodiment, when "pixel shifting" is performed, 90 nozzles #11 to #90 are divided into three groups. Namely, the nozzles are divided into a first group including the nozzles #1 to #30, a second group including the nozzles #31 to #60, and a third group including the nozzles #61 to #90. Different shift amounts are set for these three groups, the first to third groups.

(1) First Step

As shown in FIG. 12A, when the upstream-side end portion S1 of the medium S has not yet reached the area below the nozzles #1 to #90, the gap between the nozzles #1 to #90 of the head 21 and the printing surface of the medium S has not varied. Therefore, "pixel shifting" is not performed for the nozzles #1 to 490. Specifically, as shown in FIG. 13A for example, pieces of dummy pixel data A1 to A3 and B1 to B3, which consist of the same number of pieces of the dummy pixel data, are respectively added to each of the right and left sides of the pixel data "1" to "N5" of the image to be printed. In this case, pieces of dummy pixel data corresponding to three pixels, A1 to A3 and B1 to B3, are respectively added to each of the right and left sides of the pixel data "1" to "N5" of the image to be printed.

(2) Second Step

Next, as shown in FIG. 12B, a state is described in which the upstream-side end portion S1 of the medium S is present in the area below the third group, the nozzles #61 to #90. In this case, although the gap between the first and second groups including the nozzles #1 to #60 of the head 21 and the printing surface of the medium S has not significantly varied, the gap between the nozzles #61 to #90 of the head 21 and the printing surface of the medium S has varied to be smaller. Consequently, although "pixel shifting" is not performed for the nozzles #1 to #60, "pixel shifting" is performed for the nozzles #61 to #90.

That is, as shown in (1) in FIG. 13B, since "pixel shifting" is not performed for the nozzles #1 to #60, pieces of dummy pixel data A1 to A3 and B1 to B3, which consist of the same number of pieces of the dummy pixel data, are respectively added to each of the right and left sides of the pixel data "1" to "N5" of the image to be printed. On the other hand, "pixel shifting" is performed for the nozzles #61 to #90. Here, the way in which dummy pixel data are arranged differs between the case in which the carriage 41 moves in the certain direction (forward pass) and the case in which the carriage 41 moves in the direction opposite to the certain direction (return pass).

Specifically, as shown in (2) in FIG. 13B, when the carriage 41 moves in the certain direction (forward pass), pieces of dummy pixel data corresponding to four pixels, A1 to A4, are added to the left side of the pixel data "1" to "N5" of the image to be printed. On the other hand, pieces of dummy pixel data corresponding to two pixels, B1 and B2, are added to the right side of the pixel data "1" to "N5" of the image to be printed. In this manner, the pixel data "1" to "N5" of the image to be printed can be shifted rightward by an amount corresponding to a single pixel. Consequently, when ink is ejected from each of the nozzles #61 to #90 based on the resultant data, the timing of ink ejection from the nozzles #61 to #90 is shifted by an amount corresponding to a single pixel. In this manner, it is possible to adjust the landing position of ink ejected from the nozzles #61 to #90.

Also, when the carriage 41 moves in the direction opposite to the certain direction (return pass), pieces of dummy pixel data corresponding to two pixels, A1 and A2, are added to the left side of the pixel data "1" to "N5" of the image to be printed. On the other hand, pieces of dummy pixel data corresponding to four pixels, B1 to B4, are added to the right side of the pixel data "1" to "N5" of the image to be printed. In this manner, the pixel data "1" to "N5" of the image to be printed can be shifted leftward by an amount corresponding to a single pixel. Consequently, when ink is ejected from each of the nozzles #61 to #90 based on the resultant data, the timing of ink ejection from the nozzles #61 to #90 is shifted by an amount corresponding to a single pixel. In this manner, it is possible to adjust the landing position of ink ejected from the nozzles #61 to #90.

(3) Third Step

Further, as shown in FIG. 12C, when the upstream-side end portion S1 of the medium S is present in the area below the nozzles #31 to #90, although the gap between the nozzles #1 to #30 of the head 21 and the printing surface of the medium S has not significantly varied, the gap between the nozzles #30 to #90 of the head 21 and the printing surface of the medium S has varied to be smaller. Consequently, although "pixel shifting" is not performed for the nozzles #1 to #30, "pixel shifting" is performed for the nozzles #31 to #90.

That is, as shown in (1) in FIG. 13C, since "pixel shifting" is not performed for the nozzles #1 to #30, pieces of dummy pixel data A1 to A3 and B1 to B3, which consist of the same number of pieces of the dummy pixel data, are respectively added to each of the right and left sides of the pixel data "1" to "N5" of the image to be printed. On the other hand, "pixel shifting" is performed for the nozzles #61 to #90, and therefore the number of the dummy pixel data on each of the right and left sides of the pixel data "1" to "N5" of the image to be printed is adjusted. Here, the way in which dummy pixel data are arranged differs between the case in which the carriage 41 moves in the certain direction (forward pass) and the case in which the carriage 41 moves in the direction opposite to the certain direction (return pass). Also in the present embodiment, the shift amount differs between the second group including the nozzles #31 to #60 and the third group including the nozzles #61 to #90.

Specifically, in the case of the second group including the nozzles #31 to #60, as shown in (2) in FIG. 13C, when the carriage 41 moves in the certain direction (forward pass), pieces of dummy pixel data corresponding to four pixels, A1 to A4, are added to the left side of the pixel data "1" to "N5" of the image to be printed. On the other hand, pieces of dummy pixel data corresponding to two pixels, B1 and B2, are added to the right side of the pixel data "1" to "N5" of the image to be printed. In this manner, the pixel data "1" to "N5" of the image to be printed can be shifted rightward by an amount corresponding to a single pixel. Consequently, when ink is ejected from each of the nozzles #31 to #60 based on the resultant data, the timing of ink ejection from the nozzles #31 to #60 is shifted by an amount corresponding to a single pixel. In this manner, it is possible to adjust the landing position of ink ejected from the nozzles #31 to #60.

Also, when the carriage 41 moves in the direction opposite to the certain direction (return pass), pieces of dummy pixel data corresponding to two pixels, A1 and A2, are added to the left side of the pixel data "1" to "N5" of the image to be printed. On the other hand, pieces of dummy pixel data corresponding to four pixels, B1 to B4, are added to the right side of the pixel data "1" to "N5" of the image to be printed. In this manner, the pixel data "1" to "N5" of the image to be printed can be shifted leftward by an amount corresponding to a single pixel. Consequently, when ink is ejected from each of the nozzles #31 to #60 based on the resultant data, the timing of ink ejection from the nozzles #31 to #60 is shifted by an amount corresponding to a single pixel. In this manner, it is possible to adjust the landing position of ink ejected from the nozzles #31 to #60.

On the other hand, in the case of the third group including the nozzles #61 to #90, as shown in (3) in FIG. 13C, when the carriage 41 moves in the certain direction (forward pass), pieces of dummy pixel data corresponding to five pixels, A1 to A5, are added to the left side of the pixel data "1" to "N5" of the image to be printed. On the other hand, a piece of dummy pixel data corresponding to one pixel, B1, is added to the right side of the pixel data "1" to "N5" of the image to be printed. In this manner, the pixel data "1" to "N5" of the image to be printed can be shifted rightward by an amount corresponding to two pixels. Consequently, when ink is ejected from each of the nozzles #61 to #90 based on the resultant data, the timing of ink ejection from the nozzles #61 to #90 is shifted by an amount corresponding to two pixels. In this manner, it is possible to adjust the landing position of ink ejected from the nozzles #61 to #90.

Also, when the carriage 41 moves in the direction opposite to the certain direction (return pass), a piece of dummy pixel data corresponding to one pixel, A1, is added to the left side of the pixel data "1" to "N5" of the image to be printed. On the other hand, pieces of dummy pixel data corresponding to five pixels, B1 to B5, are added to the right side of the pixel data "1" to "N5" of the image to be printed. In this manner, the pixel data "1" to "N5" of the image to be printed can be shifted leftward by an amount corresponding to two pixels. Consequently, when ink is ejected from each of the nozzles #61 to #90 based on the resultant data, the timing of ink ejection from the nozzles #61 to #90 is shifted by an amount corresponding to two pixels. In this manner, it is possible to adjust the landing position of ink ejected from the nozzles #61 to #90.

(4) Fourth Step

As shown in FIG. 12D, when the upstream-side end portion S1 of the medium S is present in the area below the nozzles #1 to #90, since the gap between all the nozzles #1 to #90 and the printing surface of the medium S becomes smaller, "pixel shifting" is performed for the nozzles #1 to #90. In this case, the different shift amounts are set for the first group including the nozzles #1 to #30, the second group including the nozzles #31 to #60, and the third group including the nozzles #61 to #90.

Specifically, in the case of the first group including the nozzles 41 to #30, as shown in (1) in FIG. 13D, when the carriage 41 moves in the certain direction (forward pass), pieces of dummy pixel data corresponding to four pixels, A1 to A4, are added to the left side of the pixel data pieces "1" to "N5" of the image to be printed. On the other hand, pieces of dummy pixel data corresponding to two pixels, B1 and B2, are added to the right side of the pixel data "1" to "N5" of the image to be printed. In this manner, the pixel data "1" to "N5" of the image to be printed can be shifted rightward by an amount corresponding to a single pixel. Consequently, when ink is ejected from each of the nozzles 41 to #30 based on the resultant data, the timing of ink ejection from the nozzles #1 to #30 is shifted by an amount corresponding to a single pixel. In this manner, it is possible to adjust the landing position of ink ejected from the nozzles #1 to #30.

When the carriage 41 moves in the direction opposite to the certain direction (return pass), pieces of dummy pixel data corresponding to two pixels, A1 and A2, are added to the left side of the pixel data "1" to "N5" of the image to be printed. On the other hand, pieces of dummy pixel data corresponding to four pixels, B1 to B4, are added to the right side of the pixel data "1" to "N5" of the image to be printed. In this manner, the pixel data "1" to "N5" of the image to be printed can be shifted leftward by an amount corresponding to a single pixel. Consequently, when ink is ejected from each of the nozzles #31 to #60 based on the resultant data, the timing of ink ejection from the nozzles #1 to #30 is shifted by an amount corresponding to a single pixel. In this manner, it is possible to adjust the landing position of ink ejected from the nozzles #1 to #30.

In the case of the second group including the nozzles #31 to #60, as shown in (2) in FIG. 13D, when the carriage 41 moves in the certain direction (forward pass), pieces of dummy pixel data corresponding to five pixels, A1 to A5, are added to the left side of the pixel data "1" to "N5" of the image to be printed. On the other hand, a piece of dummy pixel data corresponding to one pixel, B1, is added to the right side of the pixel data "1" to "N5" of the image to be printed. In this manner, the pixel data "1" to "N5" of the image to be printed can be shifted rightward by an amount corresponding to two pixels. Consequently, when ink is ejected from each of the nozzles #31 to #60 based on the resultant data, the timing of ink ejection from the nozzles #31 to #60 is shifted by an amount corresponding to two pixels. In this manner, it is possible to adjust the landing position of ink ejected from the nozzles #31 to #60.

When the carriage 41 moves in the direction opposite to the certain direction (return pass), a piece of dummy pixel data corresponding to one pixel, A1, is added to the left side of the pixel data pieces "1" to "N5" of the image to be printed. On the other hand, pieces of dummy pixel data corresponding to five pixels, B1 to B5, are added to the right side of the pixel data "1" to "N5" of the image to be printed. In this manner, the pixel data "1" to "N5" of the image to be printed can be shifted leftward by an amount corresponding to two pixels. Consequently, when ink is ejected from each of the nozzles #31 to #60 based on the resultant data, the timing of ink ejection from the nozzles #31 to #60 is shifted by an amount corresponding to two pixels. In this manner, it is possible to adjust the landing position of ink ejected from the nozzles #31 to #60.

In the case of the third group including the nozzles #61 to #90, as shown in (3) in FIG. 13D, when the carriage 41 moves in the certain direction (forward pass), pieces of dummy pixel data corresponding to six pixels, A1 to A6, are added to the left side of the pixel data "1" to "N5" of the image to be printed. On the other hand, no dummy pixel data is added to the right side of the pixel data "1" to "N5" of the image to be printed. In this manner, the pixel data "1" to "N5" of the image to be printed can be shifted rightward by an amount corresponding to three pixels. Consequently, when ink is ejected from each of the nozzles #61 to #90 based on the resultant data, the timing of ink ejection from the nozzles #61 to #90 is shifted by an amount corresponding to three pixels. In this manner, it is possible to adjust the landing position of ink ejected from the nozzles #61 to #90.

When the carriage 41 moves in the direction opposite to the certain direction (return pass), no dummy pixel data is added to the left side of the pixel data "1" to "N5" of the image to be printed. On the other hand, pieces of dummy pixel data corresponding to six pixels, B1 to B6, are added to the right side of the pixel data "1" to "N5" of the image to be printed. In this manner, the pixel data "1" to "N5" of the image to be printed can be shifted leftward by an amount corresponding to three pixels. Consequently, when ink is ejected from each of the nozzles #61 to #90 based on the resultant data, the timing of ink ejection from the nozzles #61 to #90 is shifted by an amount corresponding to two pixels. In this manner, it is possible to adjust the landing position of ink ejected from the nozzles #61 to #90.

Supplementary Comment

In FIGS. 12A to 12D, a case is illustrated as an example in which the upstream-side end portion 51 of the medium S becomes warped; and, there are cases in which the downstream-side end portion (front end portion) of the medium S is warped in a similar manner. The method described with reference to FIGS. 13A to 13D can be applied also to the cases in which the downstream-side end portion (front end portion) of the medium S is warped in this manner.

Other Adjusting Methods

In the foregoing embodiment, the landing position of ink is adjusted by shifting the timing of ink ejection from nozzles using a technique called "pixel shifting". However, other techniques are available as a method for shifting the timing of ink ejection from nozzles. One of such techniques is called "waveform shifting". This "waveform shifting" is described in detail below.

Outline of Waveform Shifting

This "waveform shifting" involves shifting the timing of outputting the latch signal LAT. Through this, the timing at which the original drive signal ODRV is output from an original drive signal generating section 221 is shifted, thereby adjusting the timing of ink ejection from the nozzles #1 to #90 of each of the nozzle rows 211C, 211M, 211Y, and 211K.

Figure 14:
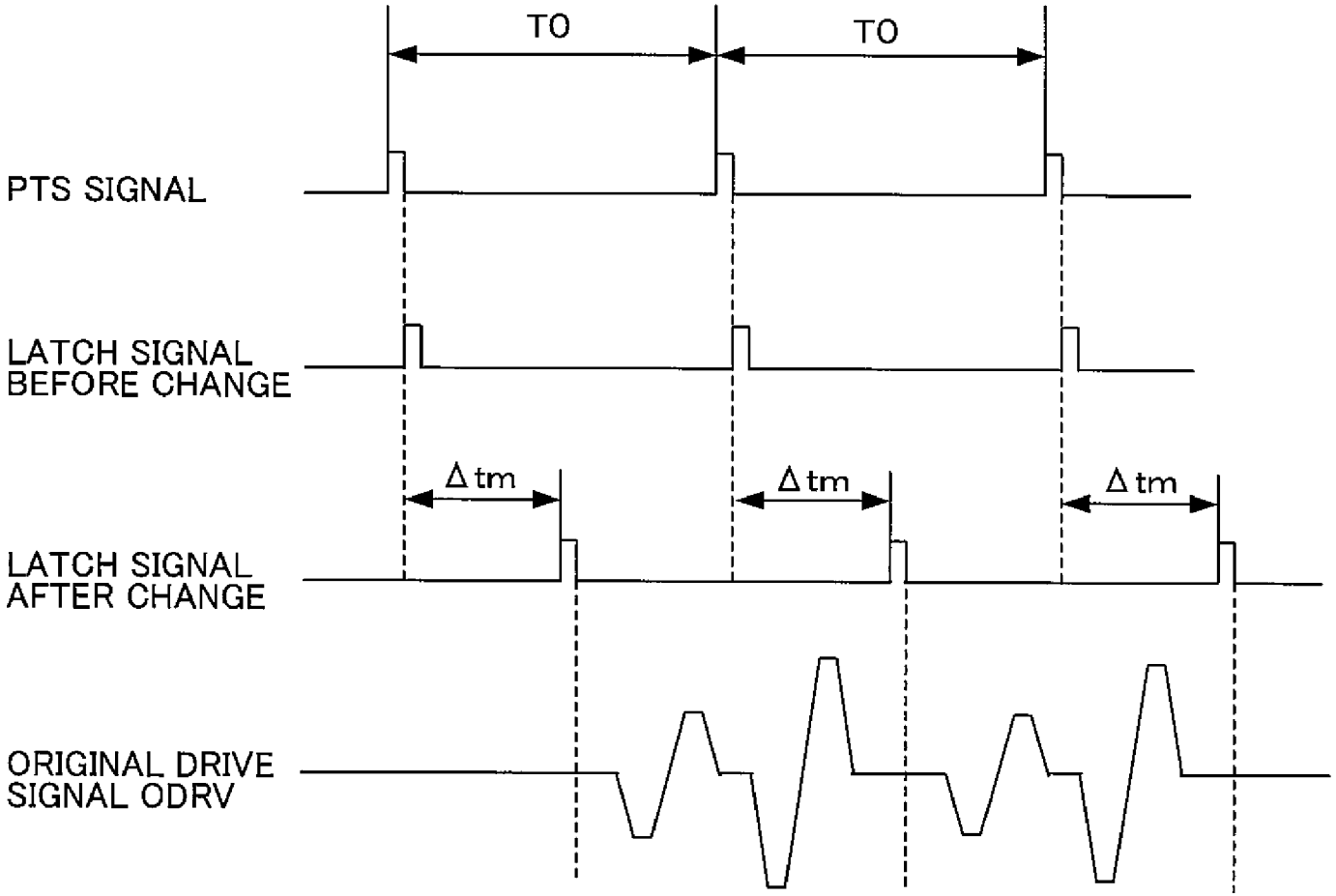
FIG. 14 illustrates an outline of "waveform shifting".

FIG. 14 simply illustrates an outline of "waveform shifting". In "waveform shifting", the generation timing of a pulse generated in the latch signal LAT, the latch signal LAT being generated based on the PTS signal, is shifted by delaying the generation timing by Δtm for example, as shown in the figure. That is, when a pulse is generated in the PTS signal, without immediately generating a pulse in the latch signal LAT in response thereto, the generation timing of the pulse in the latch signal LAT is shifted by delaying the generation timing by Δtm, for example. It should be noted that the timing defined by the pulse generated in the PTS signal corresponds to a "certain reference timing".

As a result of delaying the generation timing of a pulse in the latch signal LAT in this manner, the output timing of the original drive signal ODRV from the original drive signal generating section 221 is also delayed by Δtm. Accordingly, the timing to supply the original drive signal ODRV to the piezo element is delayed, thereby the timing of ink ejection from the nozzles #1 to #90 is shifted.

In view of this, by setting an appropriate time interval Δtm by which generation of a pulse in the latch signal LAT is delayed, even if the gap between the nozzles #1 to #90 and the printing surface of the medium S varies as described with reference to FIG. 10, it is possible to perform adjustment such that the landing positions of the ink ejected from the nozzles #1 to #90 in the forward pass and return pass match each other.

Actual Application Examples

In the above-described "waveform shifting", the generation timing of a pulse in the latch signal LAT is delayed so as to adjust the timing of ink ejection from the nozzles #1 to #90. In such a case, since the timing of ink ejection from the nozzles #1 to #90 is defined based on the same latch signal LAT, the timing of ink ejection from each of the nozzles #1 to #90 is substantially the same. However, the gap between the nozzles #1 to #90 and the printing surface varies depending on positions of the nozzles #1 to #90. Therefore, in order to perform adjustment such that the landing positions of ink in the forward pass and return pass match each other even if ink is ejected from the nozzles #1 to #90 at substantially the same timing, it is favorable to perform "waveform shifting" such that the timing of ink ejection is shifted individually depending on the positions of the nozzles #1 to #90.

Accordingly, in order to perform "waveform shifting" as individually for the nozzles #1 to #90 as possible, the nozzles #1 to #90 are divided into three groups and "waveform shifting" is performed for each group. It should be noted that in this description, a case is described as an example in which the nozzles #1 to #90 are divided into a first group including the nozzles #1 to #30, a second group including the nozzles #31 to #60, and a third group including the nozzles #61 to #90.

Exemplary Circuit Configuration

Figure 15:
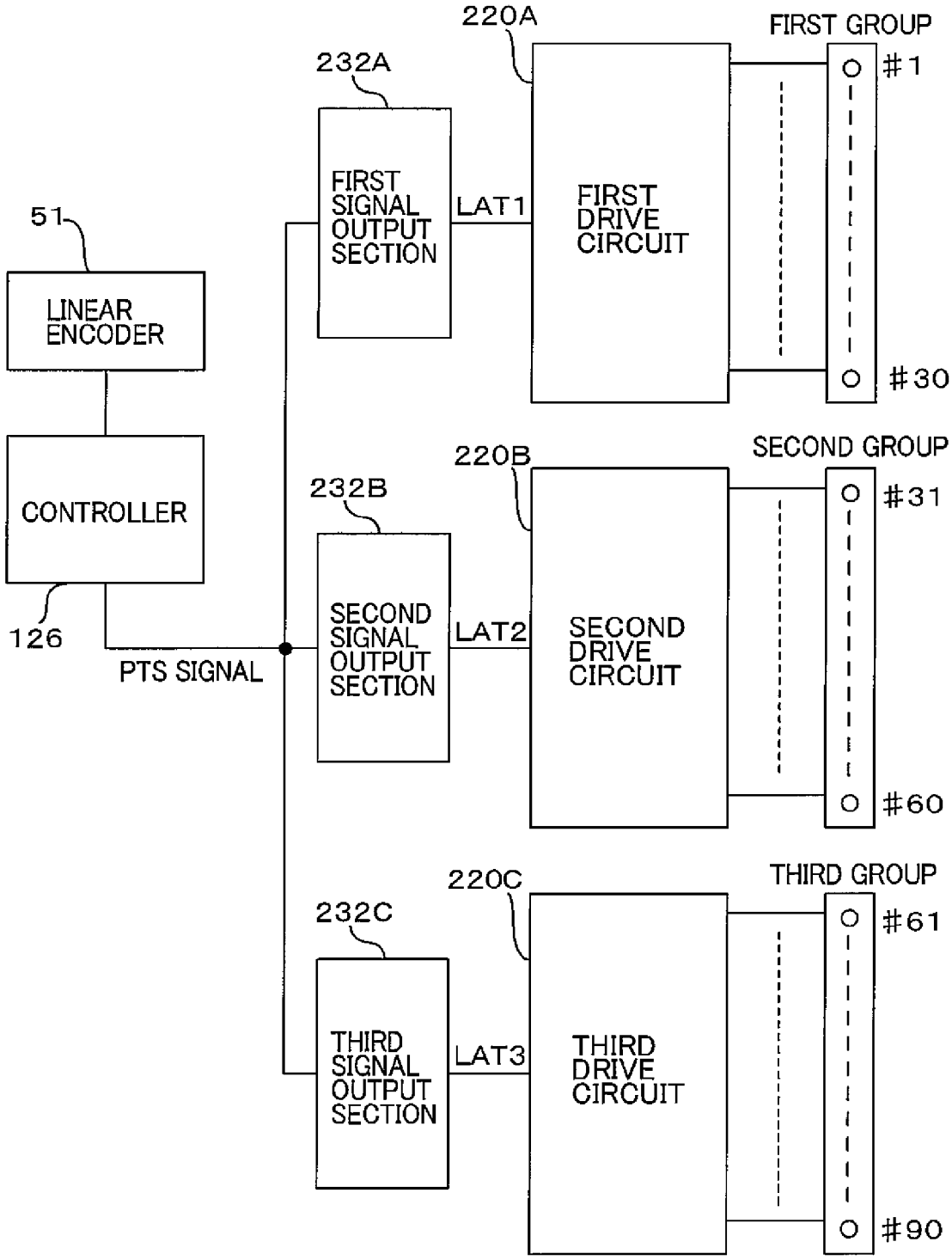
FIG. 15 shows an exemplary configuration provided with three drive circuits.

FIG. 15 shows an exemplary configuration for performing "waveform shifting", with the nozzles #1 to #90 being divided into three groups. In order to perform "waveform shifting" for each of three groups into which the nozzles #1 to #90 are divided, each group is required to have its own drive circuit 220. Therefore, three drive circuits, a first drive circuit 220A, a second drive circuit 220B, and a third drive circuit 220C, are provided as the drive circuit 220 for the nozzles #1 to #90. The first drive circuit 220A drives the nozzles #1 to #30. The second drive circuit 220B drives the nozzles #31 to #60. The third drive circuit 220C drives the nozzles #61 to #90.

These first drive circuit 220A, second drive circuit 220B, and third drive circuit 220C have the same configuration as that of the drive circuit 220 described with reference to FIG. 6. That is, each of the first drive circuit 220A, the second drive circuit 220B, and the third drive circuit 220C is provided with a drive signal generating circuit 222, a data selector 230, a latch circuit group 228, first shift registers 224, second shift registers 226 or the like for driving piezo elements PZT (1) to (30), PZT (31) to (60), or PZT(61) to (90), which are respectively provided corresponding to the nozzles #1 to #30, the nozzles #31 to #60, or the nozzles #61 to #90.

Then, first to third latch signals LAT1, LAT2, and LAT3 are output from a first signal output section 232A, a second signal output section 232B, and a third signal output section 232C, respectively; the first to third latch signals LAT1, LAT2, and LAT3 being for driving the drive signal generating circuit 222, the data selector 230, the latch circuit group 228, the first shift registers 224, the second shift registers 226 or the like provided in each of the first drive circuit 220A, the second drive circuit 220B, and the third drive circuit 220C.

The first signal output section 232A, the second signal output section 232B, and the third signal output section 232C receive as input the PTS signal output from the controller 126. The first signal output section 232A, the second signal output section 232B, and the third signal output section 232C individually generate the first to third latch signals LAT1, LAT2, and LAT3 based on the PTS signal output from the controller 126.

Here, the first signal output section 232A, the second signal output section 232B, and the third signal output section 232C can individually change the timing defined by the latch signals LAT1, LAT2, and LAT3. In other words, the first signal output section 232A, the second signal output section 232B, and the third signal output section 232C can individually generate a signal that defines a timing shifted from an original timing defined based on the timing defined by the PTS signal output from the controller 126, as the first to third latch signals LAT1, LAT2, and LAT3.

Latch Signals

Figure 16:
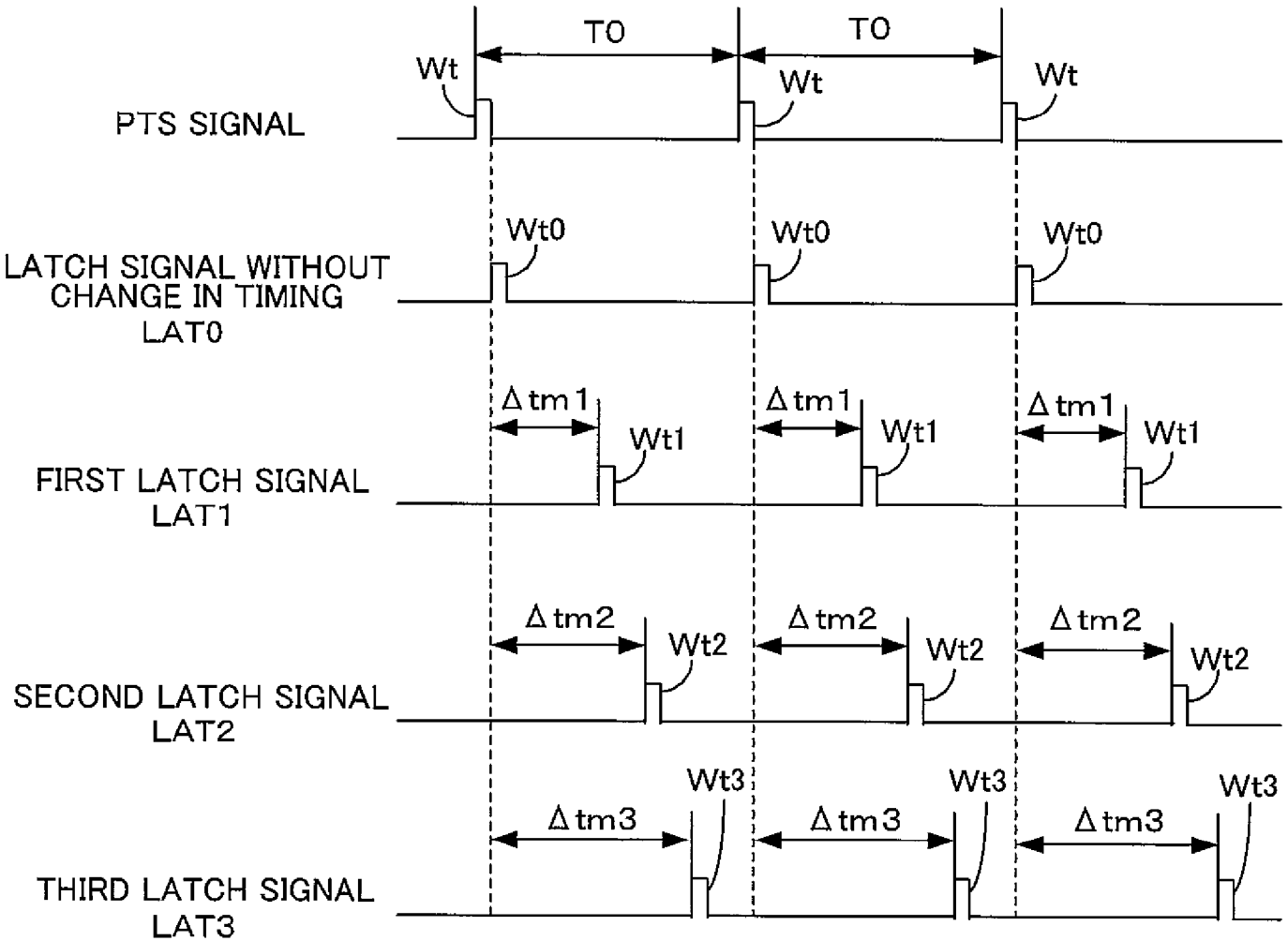
FIG. 16 illustrates first to third latch signals.

FIG. 16 illustrates the first to third latch signals LAT1, LAT2, and LAT3 generated by the first signal output section 232A, the second signal output section 232B, and the third signal output section 232C.

A latch signal LAT0 whose timing is not changed includes a pulse Wt0 that is generated immediately in response to a pulse Wt generated in the PTS signal. On the other hand, the first latch signal LAT1, the second latch signal LAT2, and the third latch signal LAT3, whose timings are changed by the first signal output section 232A, the second signal output section 232B, and the third signal output section 232C, respectively include a pulse Wt1, a pulse Wt2, and a pulse Wt3 that are generated at respective delayed timings compared with the latch signal LAT0 whose timing is not changed.

Here, the first latch signal LAT1 includes the pulse Wt1 generated at a timing delayed by a time interval Δtm1 compared with the latch signal LAT0 whose timing is not changed. The second latch signal LAT2 includes the pulse Wt2 generated at a timing delayed by a time interval Δtm2 compared with the latch signal LAT0 whose timing is not changed. Also, the third latch signal LAT3 includes the pulse Wt3 generated at a timing delayed by a time interval Δtm3 compared with the latch signal LAT0 whose timing is not changed.

In this manner, the first signal output section 232A, the second signal output section 232B, and the third signal output section 232C can individually generate the first latch signal LAT1, the second latch signal LAT2, and the third latch signal LAT3, by delaying their generation timings by the time intervals Δtm1, Δtm2, and Δtm3, respectively.

Adjustment Pattern

Figure 17:
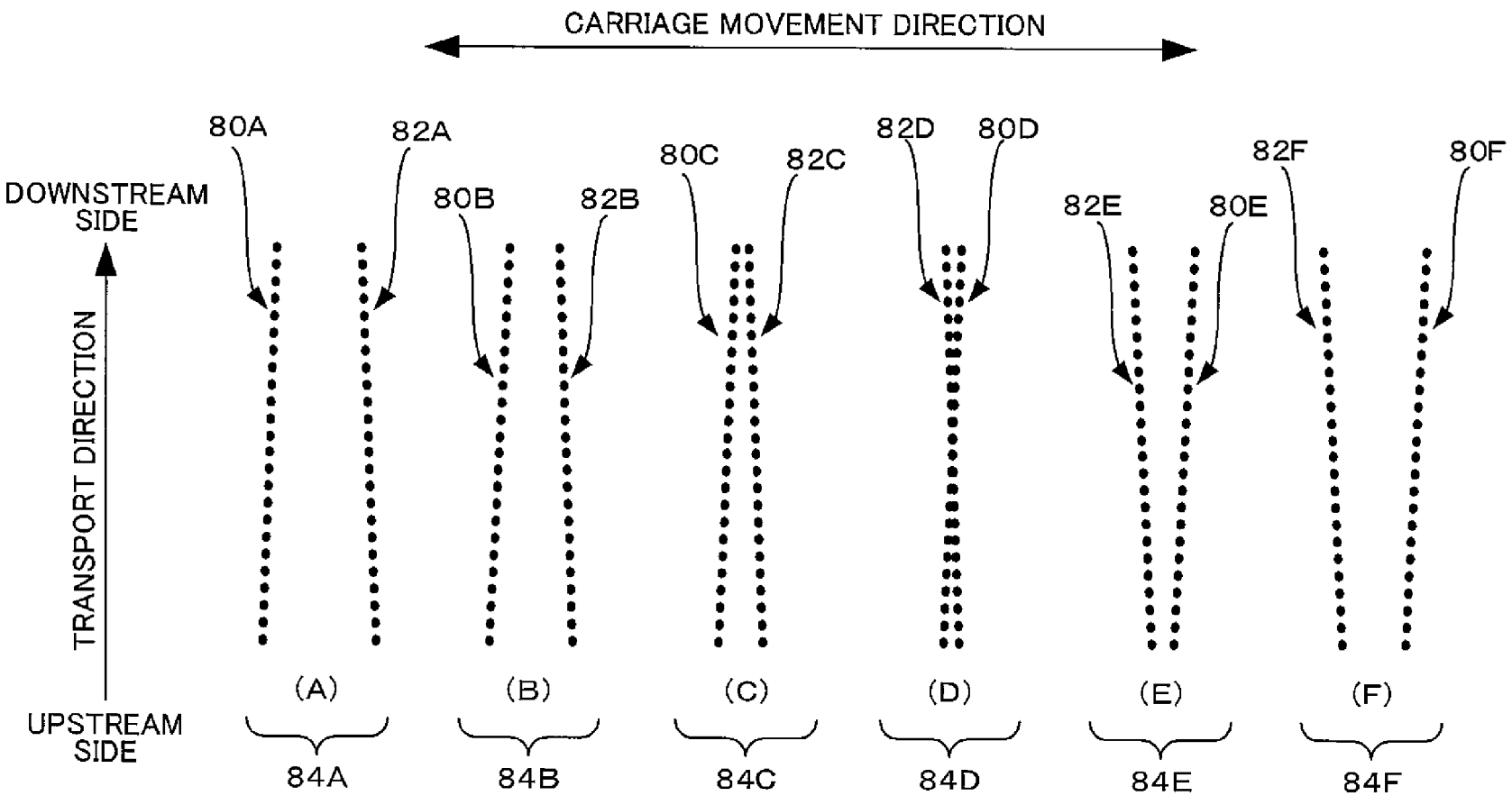
FIG. 17 illustrates an example of an adjustment pattern.

In the present embodiment, an adjustment pattern is formed on a medium in order to obtain proper adjustment values for "pixel shifting". FIG. 17 illustrates an exemplary adjustment pattern.

Here, the adjustment pattern includes, as shown in the figure, first patterns 80A, 80B, 80C, 80D, 80E, and 80F and second patterns 82A, 82B, 82C, 82D, 82E, and 82F. The first patterns 80A, 80B, 80C, 80D, 80E, and 80F are formed with ink ejected from the whole or part of the nozzles #1 to #90 while the carriage 41 is moving in the certain direction. The second patterns 82A, 82B, 82C, 82D, 82E, and 82F are formed with ink ejected from the whole or part of the nozzles #1 to #90 while the carriage 41 is moving in the direction opposite to the certain direction.

In this case, six first patterns 80A, 80B, 80C, 80D, 80E, and 80F are formed as the first pattern. Also, six second patterns 82A, 82B, 82C, 82D, 82E, and 82F are formed as the second pattern. The six first patterns 80A, 80B, 80C, 80D, 80E, and 80F formed as the first pattern are different to each other in the shifting degree of "pixel shifting". Specifically, for example, the first pattern 80A on the extreme left represents a pattern formed without "pixel shifting". The second from the left first pattern 80B represents a pattern formed by performing "pixel shifting" to the right by an amount corresponding to a single pixel. The third from the left first pattern 80C represents a pattern formed by performing "pixel shifting" to the right by an amount corresponding to two pixels. The fourth from the left first pattern 80D represents a pattern formed by performing "pixel shifting" to the right by an amount corresponding to three pixels. The fifth from the left first pattern 80E represents a pattern formed by performing "pixel shifting" to the right by an amount corresponding to four pixels. The first pattern 80F on the extreme right represents a pattern formed by performing "pixel shifting" to the right by an amount corresponding to five pixels.

Similarly, the six second patterns 82A, 82B, 82C, 82D, 82E, and 82F formed as the second pattern are different to each other in the shifting degree of "pixel shifting". Specifically, for example, the second pattern 82A on the extreme left represents a pattern formed without "pixel shifting". The second from the left second pattern 82B represents a pattern formed by performing "pixel shifting" to the left by an amount corresponding to a single pixel. The third from the left second pattern 82C represents a pattern formed by performing "pixel shifting" to the left by an amount corresponding to two pixels. The fourth from the left second pattern 82D represents a pattern formed by performing "pixel shifting" to the left by an amount corresponding to three pixels. The fifth from the left second pattern 82E represents a pattern formed by performing "pixel shifting" to the left by an amount corresponding to four pixels. The second pattern 82F on the extreme right represents a pattern formed by performing "pixel shifting" to the left by an amount corresponding to five pixels.

Here, the first pattern 80A and the second pattern 82A on the extreme left are formed by performing "pixel shifting" by the same shift amount. The second from the left first pattern 80B and the second from the left second pattern 82B are formed by performing "pixel shifting" by the same shift amount. The third from the left first pattern 80C and the third from the left second pattern 82C are formed by performing "pixel shifting" by the same shift amount. The fourth from the left first pattern 80D and the fourth from the left second pattern 82D are formed by performing "pixel shifting" by the same shift amount. The fifth from the left first pattern 80E and the fifth from the left second pattern 82E are formed by performing "pixel shifting" by the same shift amount. The sixth from the left first pattern 80F and the sixth from the left second pattern 82F are formed by performing "pixel shifting" by the same shift amount.

Then, the first pattern 80A and the second pattern 82A on the extreme left form a pair of patterns 84A. The second from the left first pattern 80B and the second from the left second pattern 82B form a pair of patterns 84B. The third from the left first pattern 80C and the third from the left second pattern 82C form a pair of patterns 84C. The fourth from the left first pattern 80D and the fourth from the left second pattern 82D form a pair of patterns 84D. The fifth from the left first pattern 80E and the fifth from the left second pattern 82E form a pair of patterns 84E. The sixth from the left first pattern 80F and the sixth from the left second pattern 82F form a pair of patterns 84F.

In order to obtain proper adjustment values for "pixel shifting", the most suitable pair of patterns is selected from among these six pairs of patterns 84A, 84B, 84C, 84D, 84E, and 84F. Here, a pair of patterns is selected in which the first pattern formed with ink ejected from the whole or part of the nozzles #1 to #90 while the carriage 41 is moving in the certain direction, and the second pattern formed with ink ejected from the whole or part of the nozzles #1 to #90 while the carriage 41 is moving in the direction opposite to the certain direction overlap each other. That is, the pair of patterns selected in this case is the pair of patterns 84D, which is the fourth pair from the left.

In the present embodiment, signs (A) to (F) are assigned respectively to these six pairs of patterns 84A, 84B, 84C, 84D, 84E, and 84F. In setting a proper adjustment value for "pixel shifting", the sign corresponding to the most suitable pair of patterns is input. In other words, in this case, the sign (D) corresponding to the pair of patterns 84D, which is the fourth pair from the left, is set as the most proper adjustment value.

It should be noted that the first patterns 80A, 80B, 80C, 80D, 80E, and 80F and the second patterns 82A, 82B, 82C, 82D, 82E, and 82F are formed as the adjustment pattern by performing "pixel shifting"; however, these first patterns 80A, 80B, 80C, 80D, 80E, and 80F and second patterns 82A, 82B, 82C, 82D, 82E, and 82F may be formed by performing "waveform shifting".

Actual Method for Forming Adjustment Patterns

Figure 18:
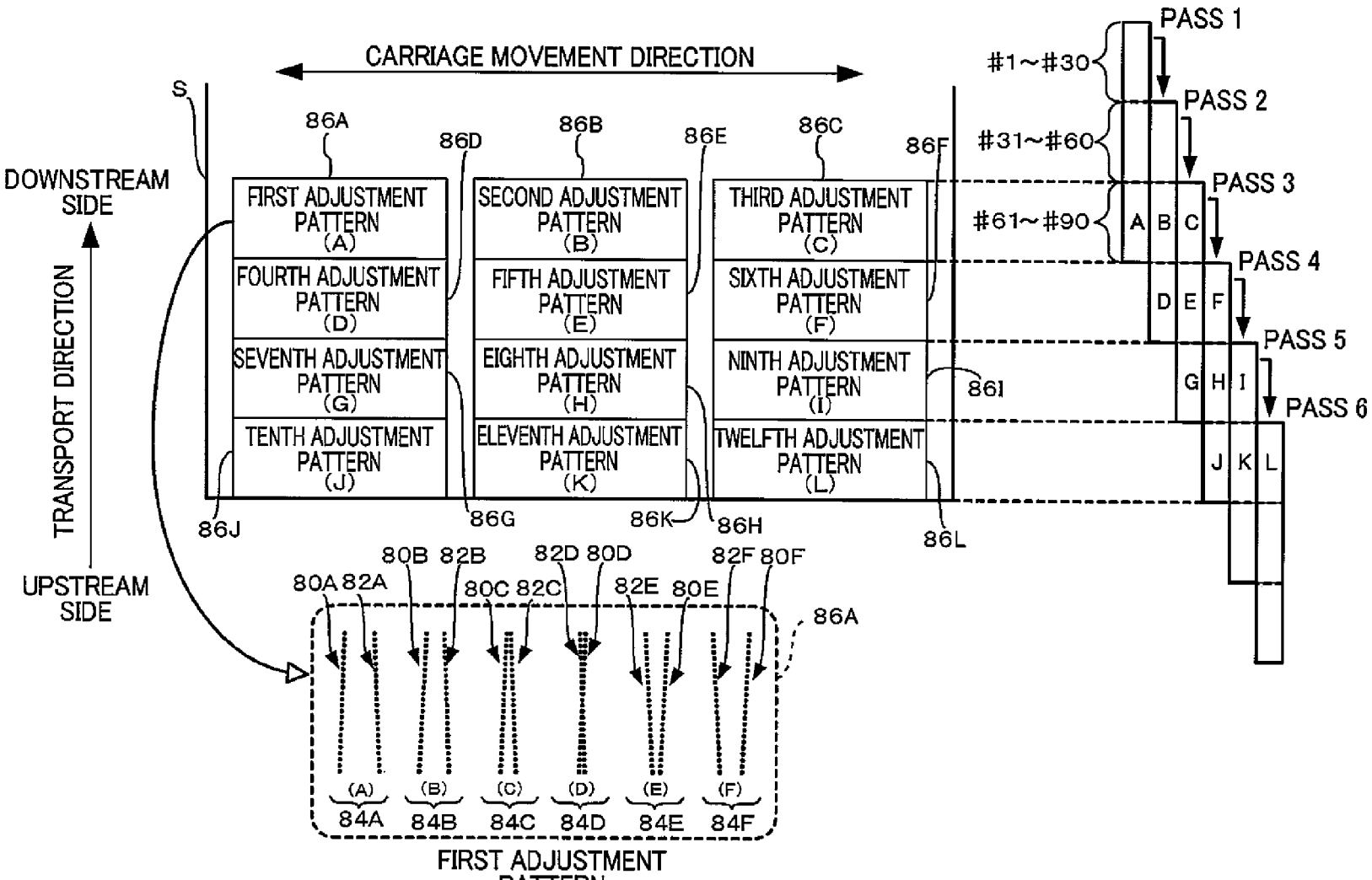
FIG. 18 illustrates an example of an actual method for forming the adjustment pattern.

FIG. 18 illustrates an example of an actual method for forming adjustment patterns. In this example, twelve adjustment patterns, namely, first to twelfth adjustment patterns 86A, 86B, 86C, 86D, 86E, 86F, 86G, 86H, 86I, 86J, 86K, and 86L are formed on the medium S. These first to twelfth adjustment patterns 86A, 86B, 86C, 86D, 86E, 86F, 86G, 86H, 86I, 86J, 86K, and 86L are formed in the vicinity of the upstream-side end portion S1 of the medium S. It should be noted that adjustment performed in the case where the upstream-side end portion S1 of the medium S is warped is described as an example; however, adjustment can be performed by forming similar adjustment patterns also in the case where the downstream-side end portion (front end portion) of the medium S is warped.

Each of these first to twelfth adjustment patterns 86A, 86B, 86C, 86D, 86E, 86F, 86G, 861, 86I, 86J, 86K, and 86L includes first patterns and second patterns, such as those illustrated in FIG. 17.

In the figure, the first adjustment pattern 86A is depicted in detail. The first adjustment pattern 86A includes, for example, six first patterns 80A, 80B, 80C, 80D, 80E, and 80F, and six second patterns 82A, 82B, 82C, 82D, 82E, and 82F. The first patterns 80A, 80B, 80C, 80D, 80E, and 80F are formed with the ink ejected while the carriage 41 is moving in the certain direction. These first patterns 80A, 80B, 80C, 80D, 80E, and 80F are different to each other in the shifting degree of "pixel shifting". The second patterns 82A, 82B, 82C, 82D, 82E, and 82F are formed with the ink ejected while the carriage 41 is moving in the direction opposite to the certain direction. These second patterns 82A, 82B, 82C, 82D, 82E, and 82F are different to each other in the shifting degree of "pixel shifting".

The first pattern 80A and the second pattern 82A are formed by performing "pixel shifting" by the same shift amount, and form a pair of patterns 84A. The first pattern 80B and the second pattern 82B are formed by performing "pixel shifting" by the same shift amount, and form a pair of patterns 84B. The first pattern 80C and the second pattern 82C are formed by performing "pixel shifting" by the same shift amount, and form a pair of patterns 84C. The first pattern 80D and the second pattern 82D are formed by performing "pixel shifting" by the same shift amount, and form a pair of patterns 84D. The first pattern 80E and the second pattern 82E are formed by performing "pixel shifting" by the same shift amount, and form a pair of patterns 84E. The first pattern 80F and the second pattern 82F are formed by performing "pixel shifting" by the same shift amount, and form a pair of patterns 84F.

Then, the most suitable pair of patterns is selected from among these six pairs of patterns 84A, 84B, 84C, 84D, 84E, and 84F. Here, a pair of patterns is selected in which the first pattern formed with the ink ejected while the carriage 41 is moving in the certain direction, and the second pattern formed with the ink ejected while the carriage 41 is moving in the direction opposite to the certain direction overlap each other.

Other adjustment patterns, namely, the second to twelfth adjustment patterns 86B, 86C, 86D, 86E, 86F, 86G, 86H, 86I, 86J, 86K, and 86L also each include first patterns and second patterns, as the first adjustment pattern 86A. The most suitable pair of patterns is selected for each of the adjustment patterns 86B, 86C, 86D, 86E, 86F, 86G, 86H, 86I, 86J, 86K, and 86L.

Method for Forming Adjustment Patterns

Here, a method for forming the respective adjustment patterns (first to twelfth adjustment patterns) 86A, 863, 86C, 86D, 86E, 86F, 86G, 86H, 86I, 86J, 86K, and 86L is described.

The first adjustment pattern 86A, fourth adjustment pattern 86D, seventh adjustment pattern 86G, and tenth adjustment pattern 86J are formed with ink ejected from the nozzles #61 to #90. The second adjustment pattern 86B, fifth adjustment pattern 86E, eighth adjustment pattern 86H, and eleventh adjustment pattern 86K are formed with ink ejected from the nozzles #31 to #60. The third adjustment pattern 86C, sixth adjustment pattern 86F, ninth adjustment pattern 86I, and twelfth adjustment pattern 86L are formed with ink ejected from the nozzles #1 to #30.

The first adjustment pattern 86A is formed with ink ejected from the nozzles #61 to #90 when the nozzles #1 to #90 are disposed at a position corresponding to "pass 1" in the figure with respect to the medium S.

After the first adjustment pattern 86A is formed in this manner, the medium S is transported by a predetermined amount. In this example, the predetermined amount by which the medium S is transported is set to a distance that corresponds to 30 nozzles. After the medium S is transported, the nozzles #1 to #90 are disposed at a position corresponding to "pass 2" in the figure with respect to the medium S. At this time, the second adjustment pattern 86B is formed as a result of ink being ejected from the nozzles #31 to #60. Also at this time, the fourth adjustment pattern 86D is formed as a result of ink being ejected from the nozzles #61 to #90.

After the second adjustment pattern 86B and the fourth adjustment pattern 86D are formed in this manner, the medium S is again transported by a distance that corresponds to 30 nozzles, so that the nozzles #1 to #90 are disposed at a position corresponding to "pass 3" in the figure with respect to the medium S. At this time, the third adjustment pattern 86C is formed as a result of ink being ejected from the nozzles #1 to #30. Also at this time, the fifth adjustment pattern 86E is formed as a result of ink being ejected from the nozzles #31 to #60. Further at this time, the seventh adjustment pattern 86G is formed as a result of ink being ejected from the nozzles #61 to #90.

After the third adjustment pattern 86C, the fifth adjustment pattern 86E and the seventh adjustment pattern 86G are formed in this manner, the medium S is again transported by a distance that corresponds to 30 nozzles, so that the nozzles #1 to #90 are disposed at a position corresponding to "pass 4" in the figure with respect to the medium S. At this time, the sixth adjustment pattern 86F is formed as a result of ink being ejected from the nozzles #1 to #30. Also at this time, the eighth adjustment pattern 86H is formed as a result of ink being ejected from the nozzles #31 to #60. Further at this time, the tenth adjustment pattern 86J is formed as a result of ink being ejected from the nozzles #61 to #90.

After the sixth adjustment pattern 86F, the eighth adjustment pattern 86H, and the tenth adjustment pattern 86J are formed in this manner, the medium S is again transported by a distance that corresponds to 30 nozzles, so that the nozzles #1 to #90 are disposed at a position corresponding to "pass 5" in the figure with respect to the medium S. At this time, the ninth adjustment pattern 86I is formed as a result of ink being ejected from the nozzles #1 to #30. Also at this time, the eleventh adjustment pattern 86K is formed as a result of ink being ejected from the nozzles #31 to #60.

After the ninth adjustment pattern 86I and the eleventh adjustment pattern 86K are formed in this manner, the medium S is again transported by a distance that corresponds to 30 nozzles, so that the nozzles #1 to #90 are disposed at a position corresponding to "pass 6" in the figure with respect to the medium S. At this time, the twelfth adjustment pattern 86L is formed as a result of ink being ejected from the nozzles #1 to #30.

Through the above-described procedure, twelve adjustment patterns, namely, the first to twelfth adjustment patterns 86A, 86B, 86C, 86D, 86E, 86F, 86G, 86H, 86I, 86J, 86K, and 86L are formed on the medium S.

By forming these twelve adjustment patterns, namely, the first to twelfth adjustment patterns 86A, 86B, 86C, 86D, 86E, 86F, 86G, 86H, 86I, 86J, 86K, and 86L on the medium S in this manner, it is possible to obtain the adjustment value that is used in performing "pixel shifting", for each operation for ejecting ink carried out during a period between the operations for transporting the medium S, that is, for each pass.

Setting of Adjustment Values

It is desirable that these adjustment values are obtained with regard to the printing process performed after the upstream-side end portion S1 of the medium S has completely passed through the paper detection sensor 53 (see FIG. 3). That is, adjustment values are obtained with regard to the printing process performed after the upstream-side end portion S1 of the medium S has completely passed through the paper detection sensor 53 (see FIG. 3), in other words, after the paper detection sensor 53 ceased to detect the medium S, by forming adjustment patterns for each operation for ejecting ink carried out during a period between the operations for transporting the medium S, that is, for each pass.

Figure 19:
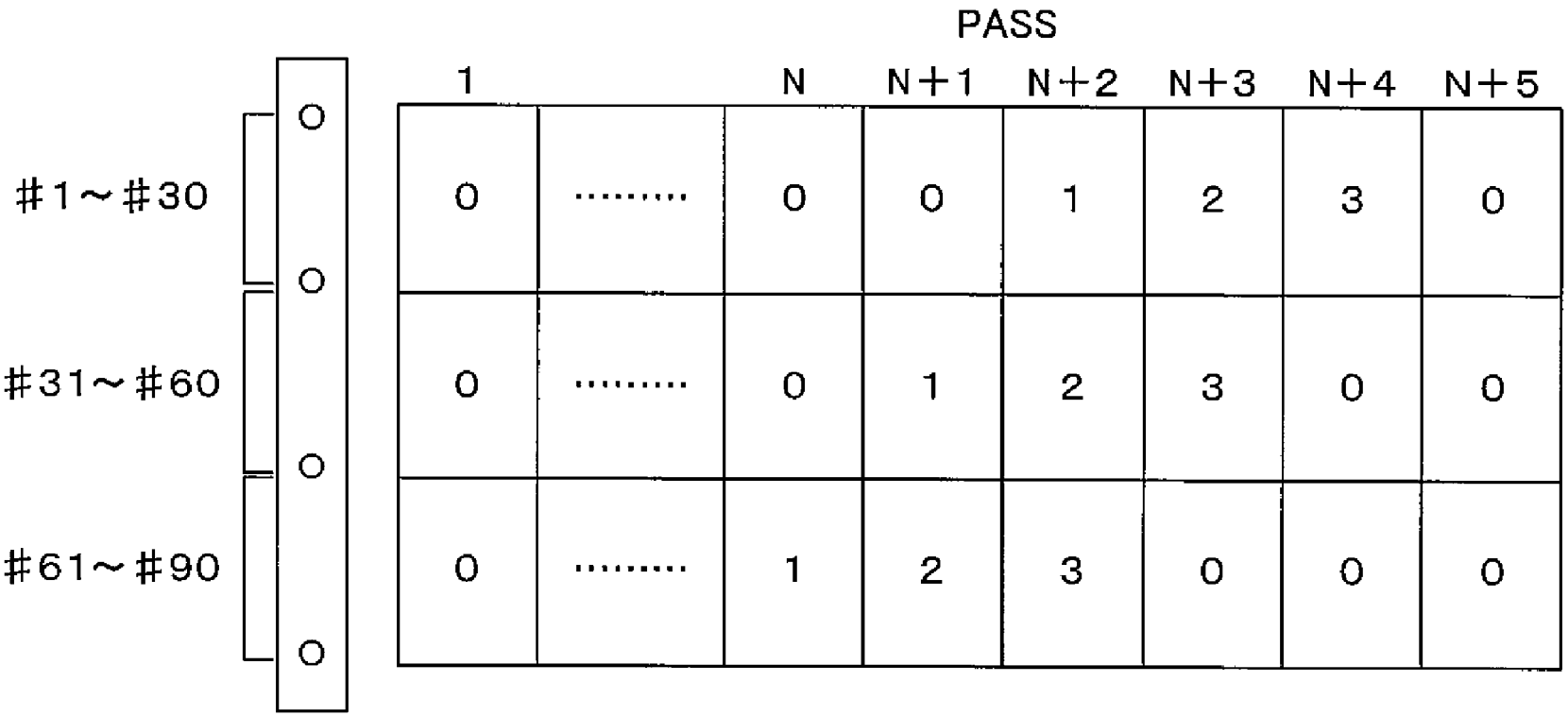
FIG. 19 shows an example of setting adjustment values obtained from the adjustment pattern.

FIG. 19 shows exemplary adjustment values obtained in this manner. Adjustment values are obtained by forming adjustment patterns for each operation for ejecting ink carried out during a period between the operations for transporting the medium S, that is, for each pass, after the paper detection sensor 53 ceased to detect the medium S. In the pass "1" performed immediately after the paper detection sensor 53 ceased to detect the medium S, the adjustment values for the nozzles #1 to #30, the nozzles #31 to #60 and the nozzles #61 to #90 are all "0". Therefore, it is not necessary to change the ink ejection timing by performing "pixel shifting".

Then, the medium S is gradually transported and when the upstream-side end portion S1 of the medium S reaches the area below the nozzles #61 to #90 of the nozzles #1 to #90 in the pass "N", the adjustment value for the nozzles #61 to #90, which are positioned on the upstream side, is set to "1" as the shift amount for "pixel shifting".

Furthermore, in the next pass "N+1", the upstream-side end portion S1 of the medium S reaches the area below the nozzles #31 to #60 as well. Therefore the adjustment value for the nozzles #31 to #60 is set to "1" as the shift amount for "pixel shifting", and the adjustment value for the nozzles #61 to #90 is set to "2" as the shift amount for "pixel shifting".

In the following pass "N+2", the upstream-side end portion S1 of the medium S reaches the area below all the nozzles #1 to #90. Therefore, the adjustment value for the nozzles #1 to #30 is set to "1" as the shift amount for "pixel shifting", the adjustment value for the nozzles #31 to #60 is set to "2" as the shift amount for "pixel shifting", and the adjustment value for the nozzles #61 to #90 is set to "3", as the shift amount for "pixel shifting".

Then, in the following pass "N+3", the upstream-side end portion S1 of the medium S has completely passed through the area below the nozzles #61 to #90. Accordingly, the adjustment value for the nozzles #61 to #90 is set to "0" as the shift amount for "pixel shifting". On the other hand, the upstream-side end portion S1 of the medium S is still present in the area below the nozzles #1 to #60. Therefore, the adjustment value for the nozzles #1 to #30 is set to "2" as the shift amount for "pixel shifting", and the adjustment value for the nozzles #31 to #60 is set to "3" as the shift amount for "pixel shifting".

In the following pass "N+4", the upstream-side end portion S1 of the medium S is present in the area below the nozzles #1 to #30 only. Therefore, the adjustment value for the nozzles #1 to #30 is set to "3" as the shift amount for "pixel shifting". For the other nozzles, namely, the nozzles #31 to #60 and the nozzles #61 to #90, the adjustment value is set to "0" as the shift amount for "pixel shifting".

Thereafter, the upstream-side end portion S1 of the medium S completely passes through the area below all the nozzles #1 to #90, and the adjustment value for all the nozzles #1 to #90 is set to "0" as the shift amount for "pixel shifting".

Comprehensive Description

In the present embodiment, as the adjustment pattern, the first patterns 80A, 80B, 80C, 80D, 80E, and 80F formed with the ink ejected from the nozzles #1 to #90 while the carriage 41 is moving in the certain direction, and the second patterns 82A, 82B, 82C, 82D, 82E, and 52F formed with the ink ejected from the nozzles #1 to #90 while the carriage 41 is moving in the direction opposite to the certain direction are formed by "pixel shifting" by the same respective shift amount. Therefore, by adjusting the timing of ink ejection from the nozzles #1 to #90, it is possible to suppress deterioration in the image quality in the upstream-side end portion or the downstream-side end portion of the medium transported. Specifically, by selecting the most suitable pair of patterns from among six pairs of patterns 84A, 84B, 84C, 84D, 84E, and 84F, which are made up of the first patterns 80A, 80B, 80C, 80D, 80E, and 80F and the second patterns 82A, 82B, 82C, 82D, 82E, and 82F, a proper shift amount can be determined in a simple manner. This enables to sufficiently suppress deterioration in the image quality in the upstream-side end portion or the downstream-side end portion of the medium transported.

Other Embodiments

Although the invention is described using the one embodiment, the above-described embodiment is used solely for the purpose of facilitating the understanding of the invention and should not be construed to limit the present invention. As a matter of course, the invention can be altered and improved without departing from the gist thereof and includes functional equivalents. In particular, the embodiments mentioned below are also included in the scope of invention.

Regarding Medium

In the foregoing embodiments, it is possible to use plain paper, matte paper, cut paper, glossy paper, roll paper, regular paper, photographic paper, and rolled photographic paper, for example, as a "medium". In addition to these, it is also possible to use film material such as OHP film or glossy film, cloth material, and sheet metal material, for example. In other words, any medium that can be printed on can be used.

Regarding Liquid

In the foregoing embodiments, cyan (C) ink, magenta (M) ink, yellow (Y) ink, black (K) ink or the like are ejected from nozzles as "liquid". However, "liquid" used herein is not limited to such inks.

Regarding Liquid Ejection Apparatus

In the foregoing embodiments, as a "liquid ejection apparatus", printing apparatuses such as the inkjet printer 1 are described as an example. However, the "liquid ejection apparatus" used herein is not limited to the inkjet printer 1 or the like. The invention applies to liquid ejection apparatuses of any type as long as they include nozzles for ejecting liquid.

What is claimed is:

1. A liquid ejection method comprising:

(A) moving nozzles relative to a medium;

(B) ejecting liquid from the nozzles while the nozzles are moving relative to the medium;

(C) forming a first pattern on the medium with the liquid ejected from the nozzles at either one of a timing delayed from a certain reference timing by a predetermined interval and a timing preceding the certain reference timing by the predetermined interval while the nozzles are moving in a certain direction with respect to the medium; and (D) when the first pattern has been formed on the medium with the liquid ejected from the nozzles at the timing delayed by the predetermined interval, forming a second pattern on the medium with the liquid ejected from the nozzles at a timing delayed from the certain reference timing by an interval equal to the predetermined interval while the nozzles are moving in a direction opposite to the certain direction with respect to the medium, and when the first pattern has been formed on the medium with the liquid ejected from the nozzles at the timing preceding by the predetermined interval, forming the second pattern on the medium with the liquid ejected from the nozzles at a timing preceding the certain reference timing by an interval equal to the predetermined interval while the nozzles are moving in the direction opposite to the certain direction with respect to the medium.

2. A liquid ejection method according to claim 1, wherein the first pattern and the second pattern are formed close to each other.

3. A liquid ejection method according to claim 1, wherein as the first pattern, a plurality of first patterns are formed with the liquid ejected from the nozzles at respective timings in which the predetermined interval differs from each other, and as the second pattern, a plurality of second patterns are each formed corresponding to each of the plurality of first patterns.

4. A liquid ejection method according to claim 1, wherein a transport section carries out a transport operation for transporting the medium along a predetermined direction, the nozzles carry out a liquid ejection operation in which the nozzles eject the liquid onto the medium while moving relative to the medium, during a period between the transport operations carried out by the transport section, and the first pattern and the second pattern are formed each time the liquid ejection operation is carried out by the nozzles.

5. A liquid ejection method according to claim 4, wherein as the nozzles, a plurality of nozzles lined up along the predetermined direction are provided, the plurality of nozzles are divided into a plurality of groups, and the first pattern and the second pattern are formed for each of the plurality of groups.

6. A liquid ejection method according to claim 1, wherein the nozzles form an image on the medium by ejecting the liquid onto the medium based on data of the image, and the timing to eject the liquid from the nozzles is changed using, in the data of the image, dummy pixel data as data of a pixel that constitutes the image.

7. A liquid ejection method according to claim 1, wherein ink is ejected from the nozzles as the liquid.

8. A liquid ejection apparatus, comprising:

(A) nozzles that eject liquid onto a medium while moving back and forth relative to the medium, (B) a controller that when the first pattern has been formed on the medium with the liquid ejected from the nozzles at a timing delayed from a certain reference timing by a predetermined interval while the nozzles are moving in a certain direction with respect to the medium, forms a second pattern on the medium with the liquid ejected from the nozzles at a timing delayed from the certain reference timing by an interval equal to the predetermined interval, while the nozzles are moving in a direction opposite to the certain direction with respect to the medium, and when the first pattern has been formed on the medium with the liquid ejected from the nozzles at a timing preceding a certain reference timing by the predetermined interval while the nozzles are moving in the certain direction with respect to the medium, forms the second pattern on the medium with the liquid ejected from the nozzles at a timing preceding the certain reference timing by an interval equal to the predetermined interval, while the nozzles are moving in the direction opposite to the certain direction with respect to the medium.

* * * * *